US009038212B2

(12) United States Patent
Yamaguchi et al.

(10) Patent No.: US 9,038,212 B2
(45) Date of Patent: May 26, 2015

(54) TRANSFER ASSISTANCE DEVICE AND OPERATION METHOD THEREFOR

(75) Inventors: Yuhei Yamaguchi, Toyota (JP); Atsushi Yoshimi, Nagoya (JP)

(73) Assignee: TOYOTA JIDOSHA KABUSHIKI KAISHA, Toyota-Shi (JP)

( * ) Notice: Subject to any disclaimer, the term of this patent is extended or adjusted under 35 U.S.C. 154(b) by 0 days.

(21) Appl. No.: 13/996,141

(22) PCT Filed: Dec. 28, 2010

(86) PCT No.: PCT/JP2010/007586

§ 371 (c)(1),
(2), (4) Date: Jun. 20, 2013

(87) PCT Pub. No.: WO2012/090248

PCT Pub. Date: Jul. 5, 2012

(65) Prior Publication Data

US 2013/0263374 A1 Oct. 10, 2013

(51) Int. Cl.
*A61G 7/10* (2006.01)

(52) U.S. Cl.
CPC ..... *A61G 7/1017* (2013.01); *A61G 7/1046* (2013.01); *A61G 7/1057* (2013.01); *A61G 7/1086* (2013.01); *A61G 2203/42* (2013.01); *A61G 2203/44* (2013.01); *A61G 2203/32* (2013.01); *A61G 2203/34* (2013.01)

(58) Field of Classification Search
CPC .. A61G 7/0526; A61G 7/1017; A61G 7/1013
USPC ..... 5/81 R, 83.1–89.1, 81.1 RP
See application file for complete search history.

(56) References Cited

U.S. PATENT DOCUMENTS

| | | | | |
|---|---|---|---|---|
| 2,439,163 | A * | 4/1948 | Farmer | 5/86.1 |
| 5,001,789 | A * | 3/1991 | Schoenberger | 5/87.1 |
| 5,484,393 | A * | 1/1996 | McCoy | 602/6 |
| 6,230,342 | B1 * | 5/2001 | Haugs | 5/607 |
| 6,389,619 | B1 * | 5/2002 | Dunn | 5/86.1 |
| 7,003,820 | B1 * | 2/2006 | Iura et al. | 5/83.1 |
| 7,392,554 | B1 * | 7/2008 | Su et al. | 5/86.1 |
| 8,621,684 | B2 * | 1/2014 | Okumatsu | 5/83.1 |
| 8,650,677 | B2 * | 2/2014 | Altena et al. | 5/87.1 |
| 2005/0006941 | A1 * | 1/2005 | Park | 297/406 |

(Continued)

FOREIGN PATENT DOCUMENTS

| | | | |
|---|---|---|---|
| JP | 2000-024040 | A | 1/2000 |
| JP | 2002-102297 | A | 4/2002 |

(Continued)

*Primary Examiner* — Nicholas Polito
*Assistant Examiner* — Eric Kurilla
(74) *Attorney, Agent, or Firm* — Kenyon & Kenyon LLP

(57) ABSTRACT

The transfer assistance device includes a front supporting part that supports the torso of the person being assisted; a set of sub supporting parts configured to be adjustable in position with respect to the front supporting part; a driving unit that propels and drives each of the set of sub supporting parts toward the person being assisted being supported by the front supporting part; a force sensor that detects a pressure proportional to propulsion of the sub supporting part by the driving unit and counterforce generated by contact of the sub supporting part with the person being assisted; and a computer that controls the driving unit based on the pressure detected by the force sensor so that tightening force on the person being assisted by the sub supporting part approaches prescribed tightening force.

10 Claims, 31 Drawing Sheets

(56) References Cited

U.S. PATENT DOCUMENTS

| | | | | |
|---|---|---|---|---|
| 2005/0217024 | A1* | 10/2005 | Aarestad | 5/86.1 |
| 2005/0242639 | A1* | 11/2005 | Ha | 297/230.1 |
| 2010/0154117 | A1* | 6/2010 | Odashima et al. | 5/87.1 |
| 2010/0162483 | A1* | 7/2010 | Biersteker et al. | 5/87.1 |
| 2011/0056019 | A1* | 3/2011 | Altena et al. | 5/87.1 |
| 2011/0083267 | A1* | 4/2011 | Gibson et al. | 5/87.1 |
| 2012/0174314 | A1* | 7/2012 | Clement et al. | 5/81.1 R |
| 2012/0255118 | A1* | 10/2012 | Hammond et al. | 5/86.1 |

FOREIGN PATENT DOCUMENTS

| | | | | |
|---|---|---|---|---|
| JP | 2008-073501 | A | 4/2008 | |
| JP | 2010-131063 | A | 6/2010 | |
| WO | WO 2009126040 | A2 * | 10/2009 | A61G 7/10 |

* cited by examiner

TRANSFER ASSISTANCE DEVICE AND OPERATION METHOD THEREFOR

CROSS REFERENCE TO RELATED APPLICATION

This is a national phase application based on the PCT International Patent Application No. PCT/JP2010/007586 filed on Dec. 28, 2010, the entire contents of which are incorporated herein by reference.

TECHNICAL FIELD

The present invention relates to a transfer assistance device and an operation method therefor.

BACKGROUND ART

A transfer assistance device that assists the transfer of a person has been developed.

A transfer aid robot that supports a person being assisted by an upper body supporting part is disclosed in Patent Literature 1. The upper body supporting part includes an underarm supporting part that supports around the underarm to a part of the back of a person being assisted, a waist supporting part that supports the waist, and a plane that holds up the belly. As is obvious from referring to FIG. 4, FIGS. 6 to 8, FIG. 12 and FIG. 13 of Patent Literature 1, the structure that supports around the upper body of a person being assisted is disclosed in Patent Literature 1. In the paragraph 0037 of Patent Literature 1, it is described that the pressure acting on the upper body of a person being assisted is reduced by enlarging the contact area. In the paragraph 0042 of Patent Literature 1, it is described that the mechanism that supports around a person being assisted operates in a passive manner with use of the weight of the person being assisted.

A transfer assistance device that is equipped with a body supporting element is disclosed in Patent Literature 2. The body supporting element shown in FIG. 3 or the like of Patent Literature 2 is equipped with a contact pressure dispersion member that disperses the contact pressure. It is described in Patent Literature 2 that this structure allows reduction of a stress suffered by a person being assisted due to large force acting on a part of the body of the person being assisted. Further, in the paragraph 0034 of Patent Literature 2, it is described that a motor is driven so that a uniform pressure is applied to a person being assisted over a wide range, preventing the contact pressure between a contact pressure sensor and the person being assisted from being high locally.

CITATION LIST

Patent Literature

PTL1: Japanese Unexamined Patent Application Publication No. 2008-73501

PTL2: Japanese Unexamined Patent Application Publication No. 2010-131063

SUMMARY OF INVENTION

Technical Problem

When lifting up/down a person being assisted, it is preferred to support the person being assisted with appropriate supporting force. When the supporting force is lower than an appropriate value, it is difficult to support the person being assisted, which causes the person being assisted to come off the supporting element. On the other hand, when the supporting force is higher than an appropriate value, it can cause the person being assisted to feel uncomfortable due to excessive tightening.

In view of the above, it is strongly required to support each person being assisted with appropriate force.

Solution to Problem

A transfer assistance device according to the present invention includes a main supporting part that supports a torso of a person being assisted, a set of sub supporting parts configured to be adjustable in position with respect to the main supporting part, a driving unit that propels and drives each of the set of sub supporting parts toward the person being assisted in a state of being supported by the main supporting part, a pressure detection unit that detects a pressure proportional to propulsion of the sub supporting part by the driving unit and counterforce generated by contact of the sub supporting part with the person being assisted, and a control unit that controls the driving unit based on a detected value of the pressure by the pressure detection unit so that tightening force on the person being assisted caused by the sub supporting part approaches prescribed tightening force.

It is preferred that the main supporting part and the set of sub supporting parts are mounted on an arm unit, the arm unit is mounted on a body unit in such a manner to allow lifting of the person being assisted, and the prescribed tightening force varies depending on a displacement of the arm unit with respect to the body unit.

It is preferred that the prescribed tightening force varies depending on a weight of the person being assisted.

In the transfer assistance device, the main supporting part is set at least in a range capable of supporting at least an entire chest of the person being assisted, the transfer assistance device further includes a deviation detection unit that detects a deviation of the torso of the person being assisted on the main supporting part, and the prescribed tightening force to be achieved by drive control of the sub supporting part varies in accordance with a detected value of the deviation detection unit.

It is preferred that the pressure detection unit receives the propulsion and the counterforce generated coaxially.

It is preferred that the set of sub supporting parts are displaced in accordance with power generated by a common power source.

It is preferred that the control unit controls the driving unit so as to prevent the tightening force on the person being assisted caused by the sub supporting part from being separated from the prescribed tightening force.

It is preferred that at least one of the set of sub supporting parts is configured to be movable along an axis line determined based on an individual difference in size of the torso of the person being assisted placed on the main supporting part.

It is preferred that a height position of the sub supporting part with respect to a supporting surface of the main supporting part or a position of the sub supporting part in a lengthwise direction of the supporting surface of the main supporting part varies in synchronization with movement of the sub supporting part along the axis line toward the torso of the person being assisted placed on the main supporting part.

An operation method for a transfer assistance device according to the present invention is an operation method for a transfer assistance device including a main supporting part that supports a torso of a person being assisted, a set of sub supporting parts configured to be adjustable in position with respect to the main supporting part, and a driving unit that propels and drives each of the set of sub supporting parts toward the person being assisted in a state of being supported by the main supporting part, the method including detecting a pressure proportional to propulsion of the sub supporting part by the driving unit and counterforce generated by contact of the sub supporting part with the person being assisted, and controlling the driving unit so that tightening force on the person being assisted caused by the sub supporting part indicated by a detected value of the pressure approaches prescribed tightening force.

Advantageous Effects of Invention

According to the present invention, it is possible to support each person being assisted with appropriate force.

DESCRIPTION OF EMBODIMENTS

Embodiments of the present invention will be described hereinbelow with reference to the drawings. The embodiment described hereinbelow are not independent of one another and can be combined as appropriate, and the effects exerted by the combination of the embodiments can be also claimed. The identical reference symbols denote identical structural elements and the redundant explanation thereof is omitted.

First Embodiment

Figure 1:
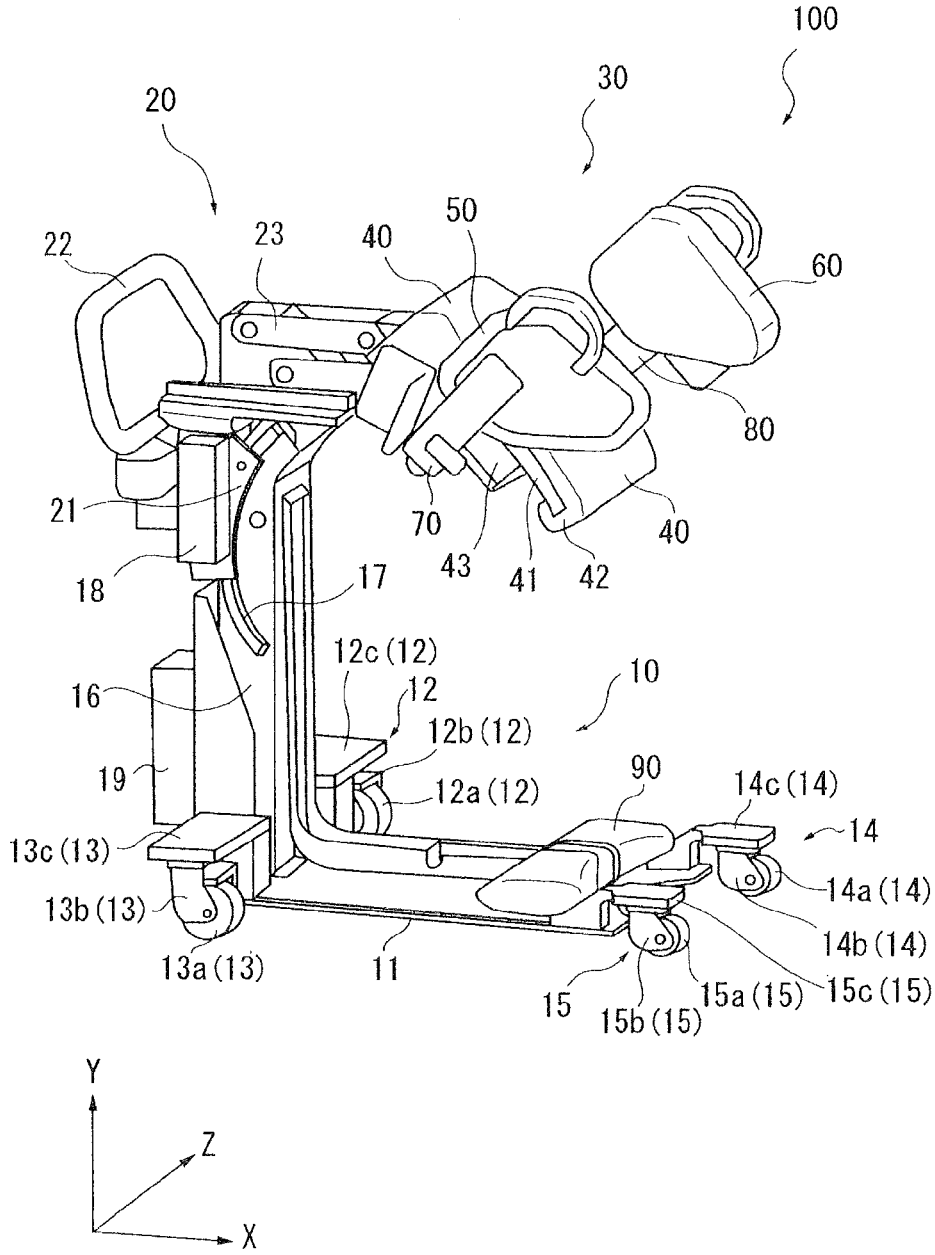
FIG. 1 is a schematic perspective view of a transfer assistance device according to a first embodiment.
Figure 2:
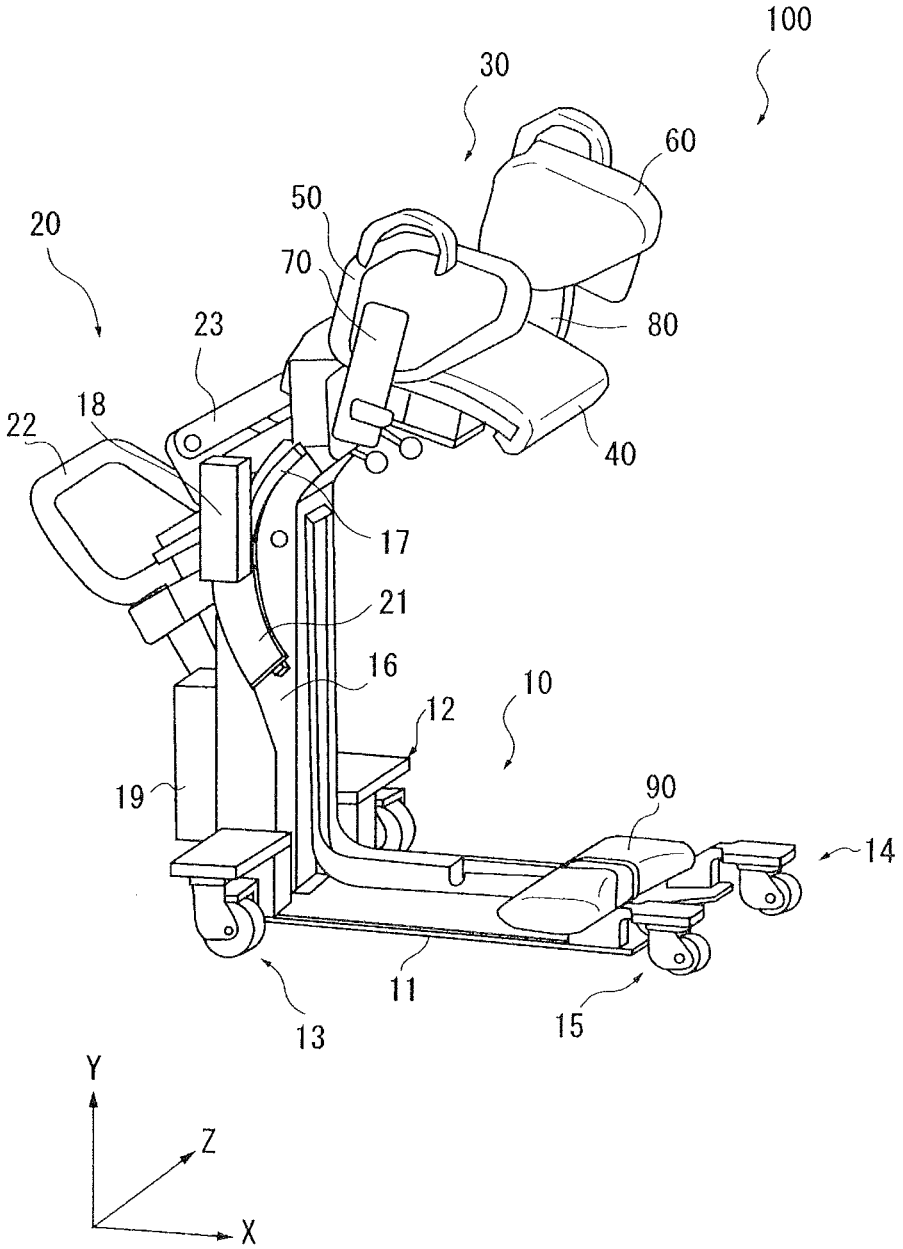
FIG. 2 is a schematic perspective view of the transfer assistance device according to the first embodiment.
Figure 3:
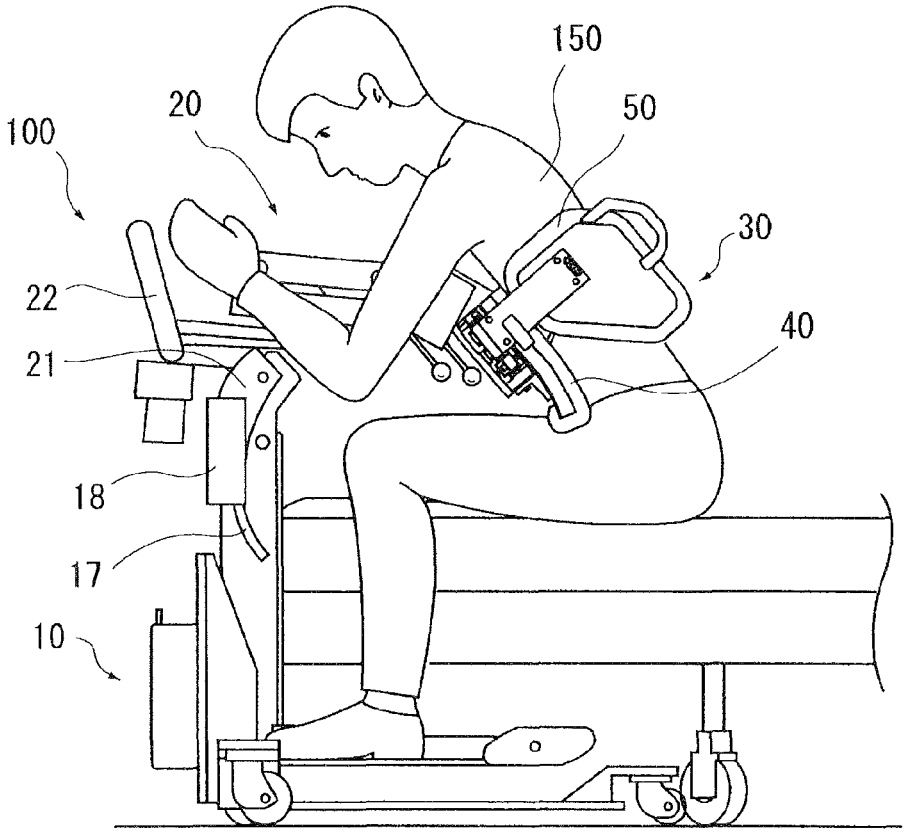
FIG. 3 is an explanatory view illustrating the operation of the transfer assistance device according to the first embodiment.
Figure 4:
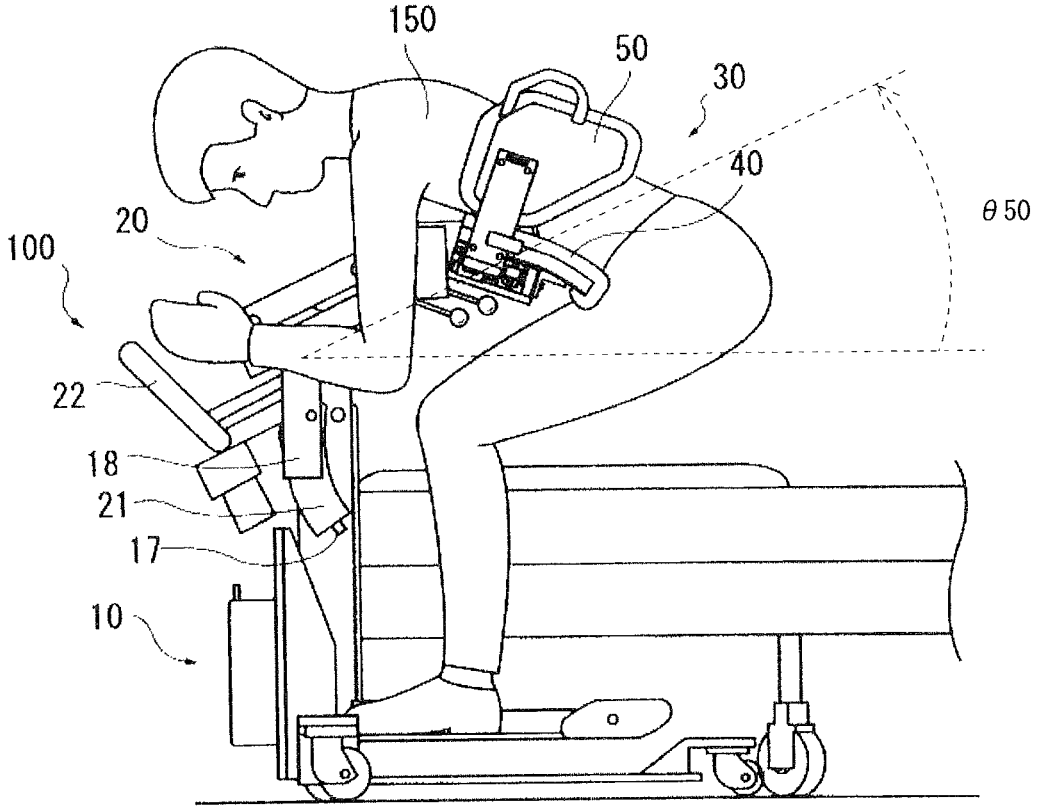
FIG. 4 is an explanatory view illustrating the operation of the transfer assistance device according to the first embodiment.
Figure 5:
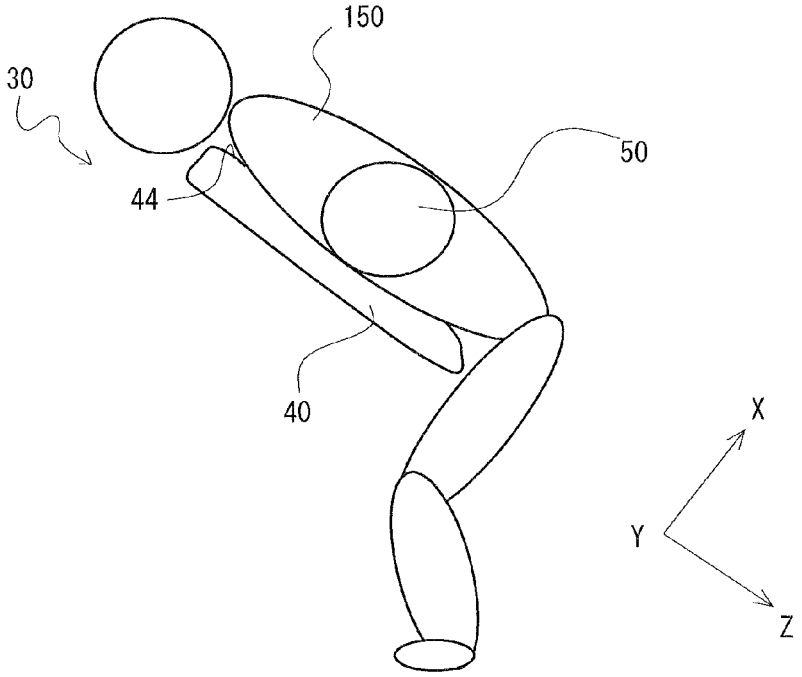
FIG. 5 is an explanatory view illustrating the structure of a side supporting part according to the first embodiment.
Figure 6:
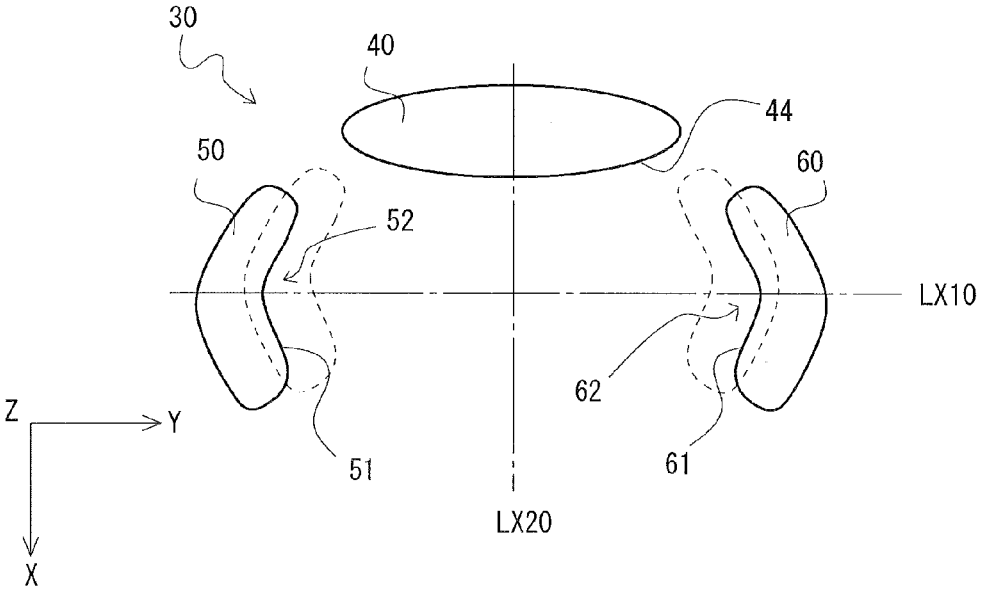
FIG. 6 is a schematic view of the side supporting part according to the first embodiment when viewed from the z-axis.
Figure 7:
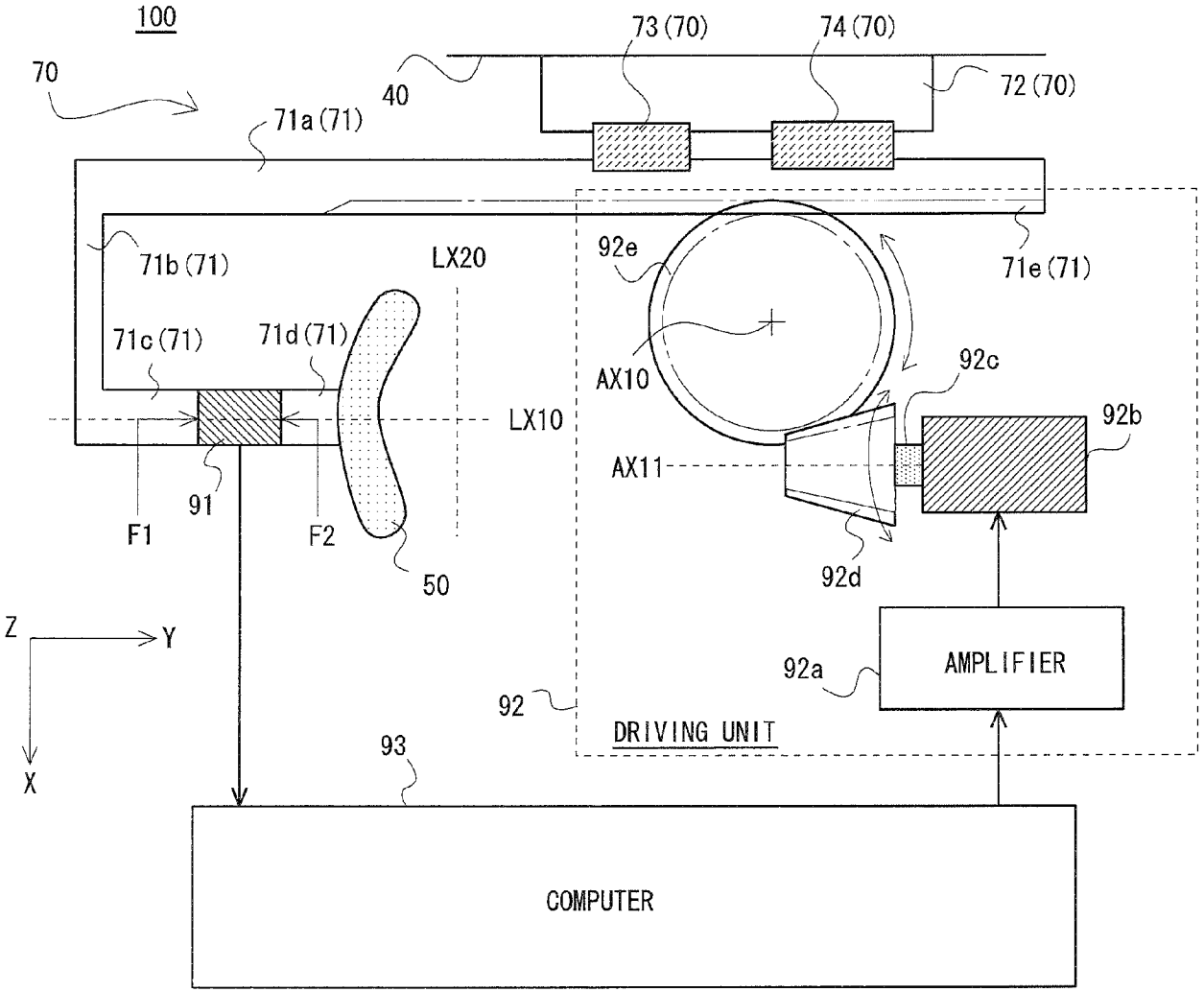
FIG. 7 is a schematic view showing the drive mechanism of the side supporting part according to the first embodiment.
Figure 8:
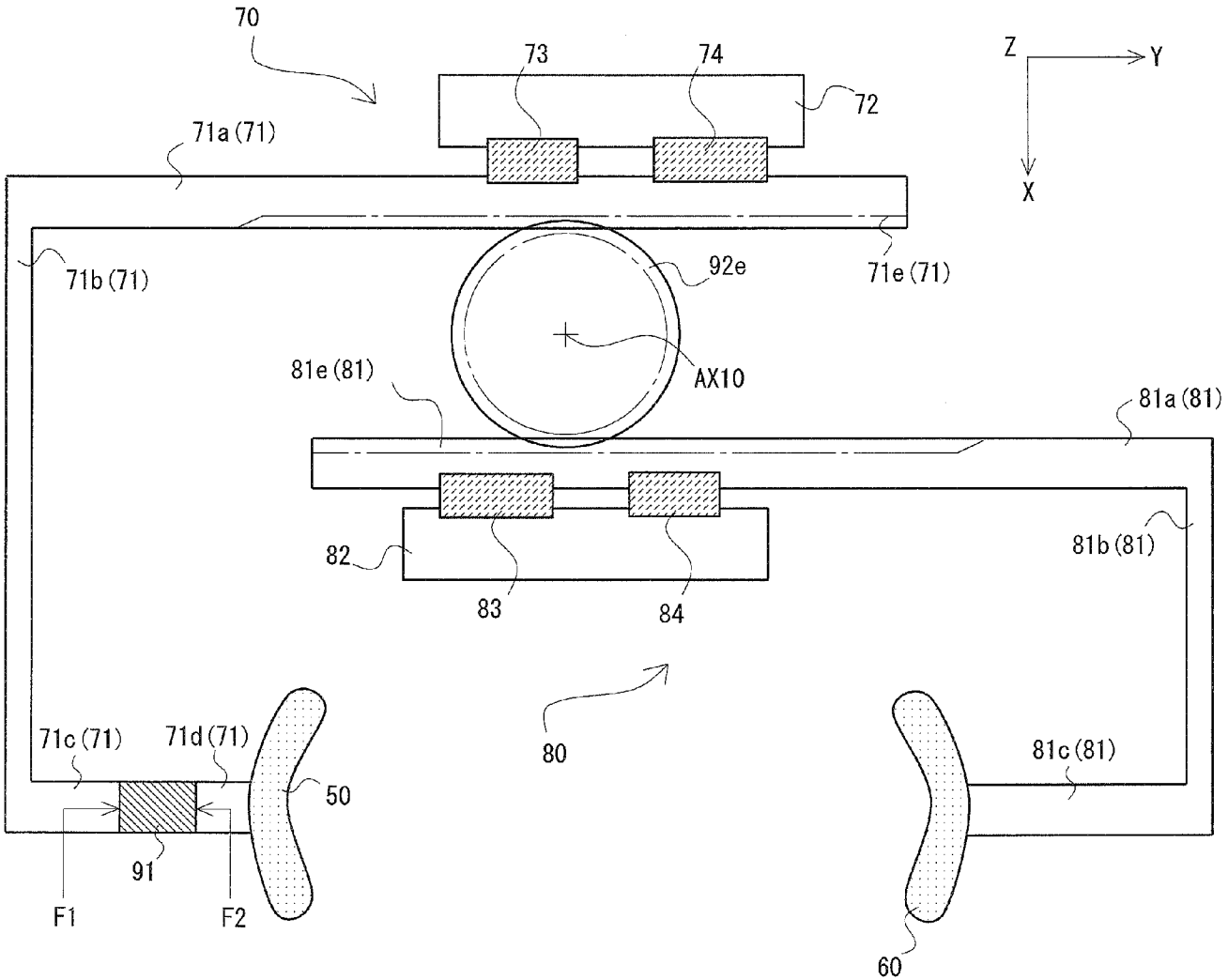
FIG. 8 is a schematic view showing the drive mechanism of the side supporting part according to the first embodiment.
Figure 9:
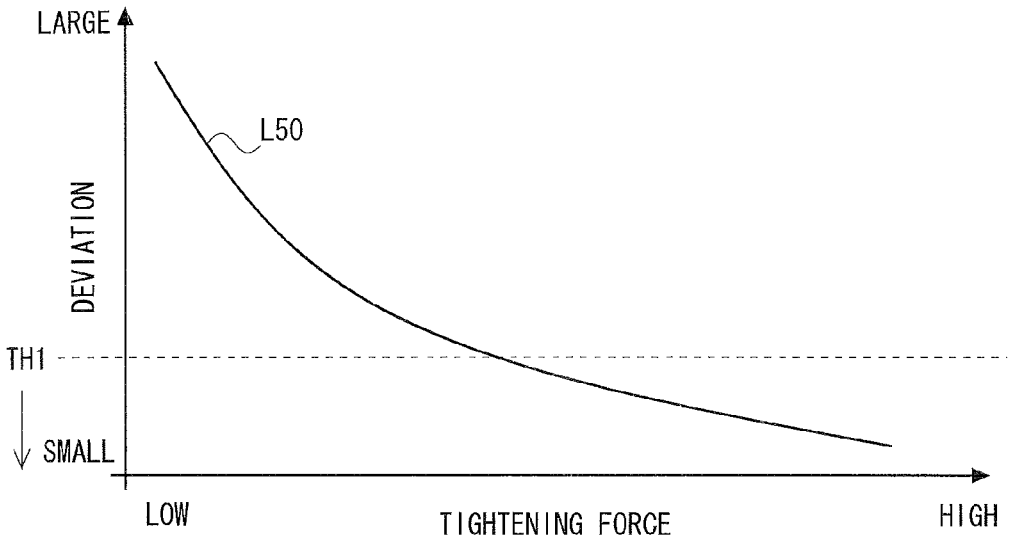
FIG. 9 is a table showing the relationship between tightening force and deviation according to the first embodiment.
Figure 10:
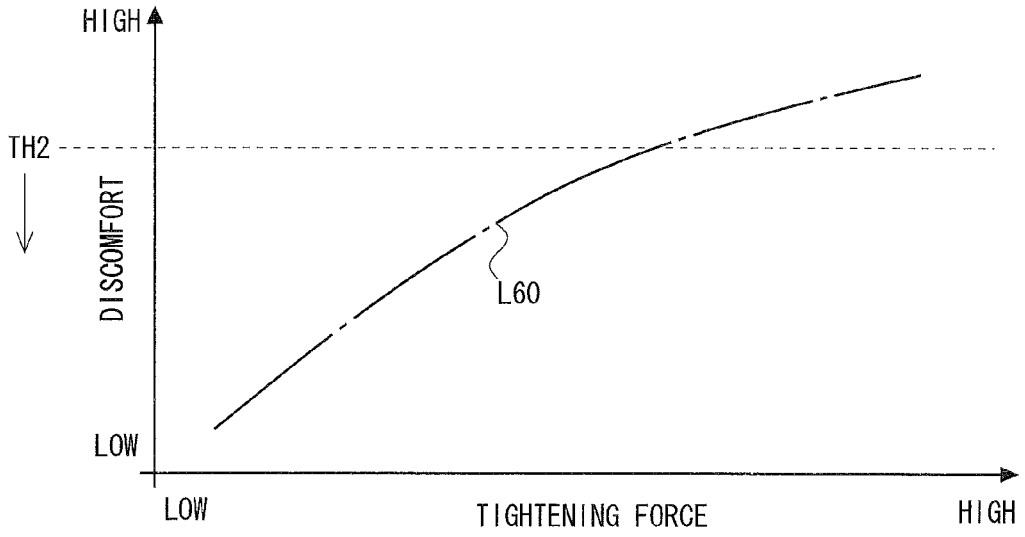
FIG. 10 is a table showing the relationship between tightening force and discomfort according to the first embodiment.
Figure 11:
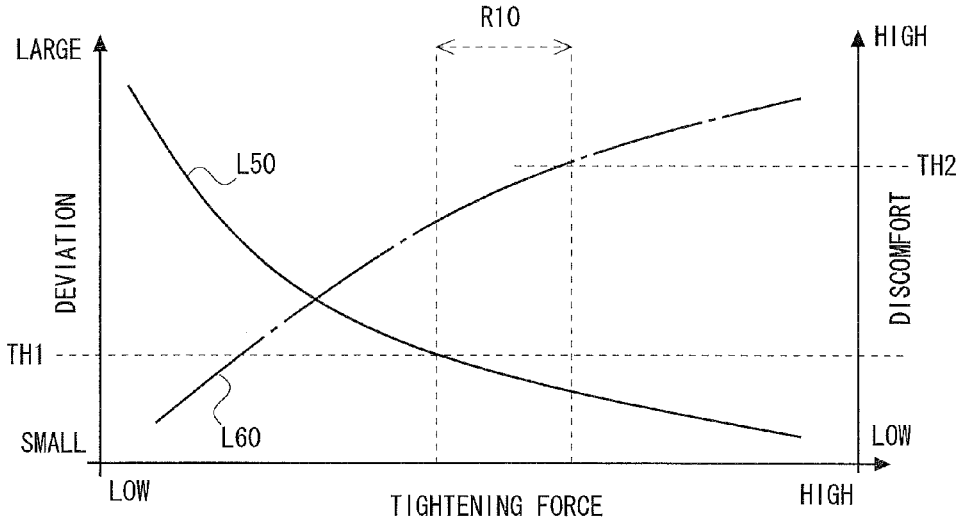
FIG. 11 is a table showing the relationship between tightening force and deviation/discomfort according to the first embodiment.
Figure 12:
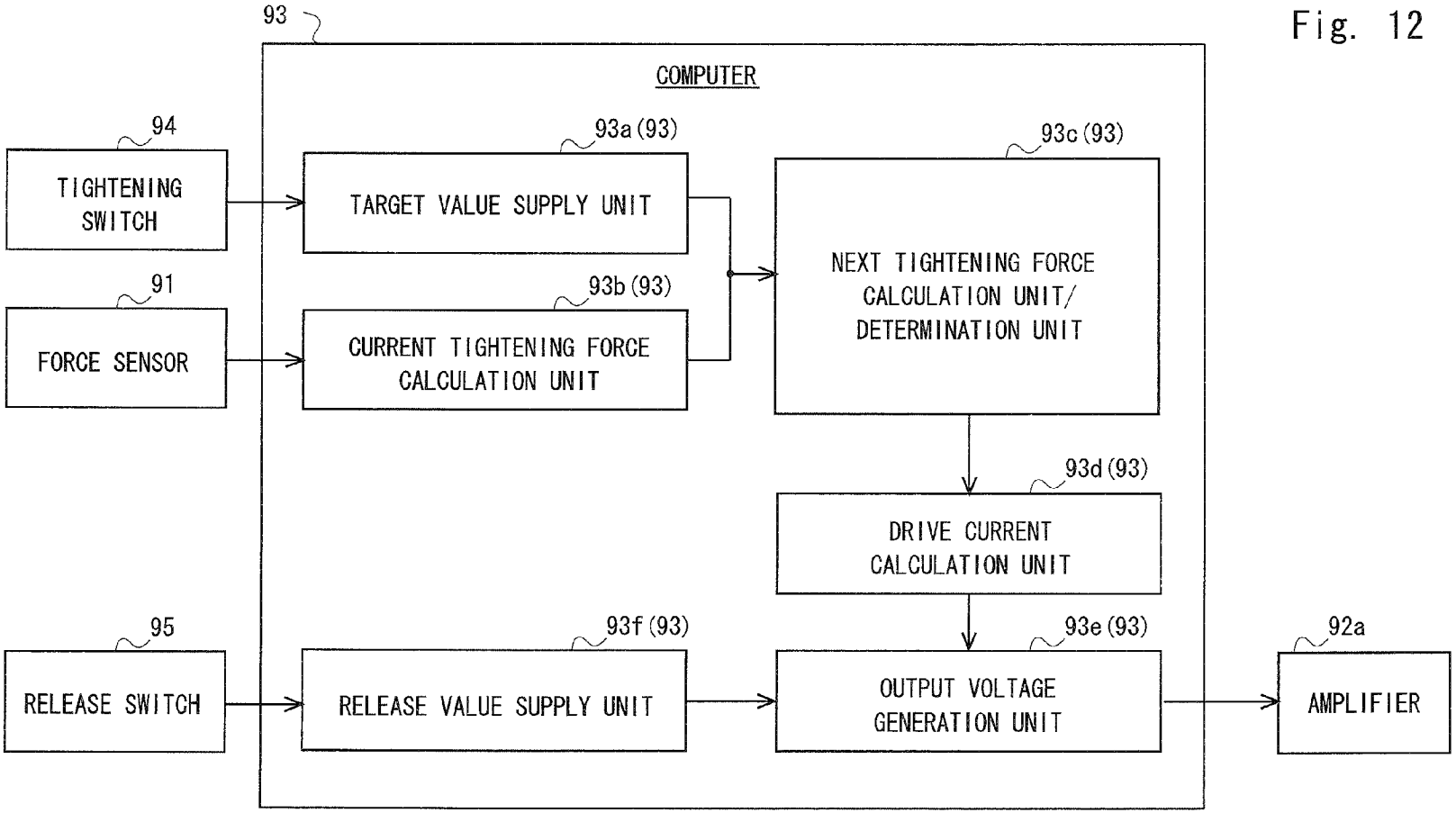
FIG. 12 is a schematic block diagram showing a configuration example of a computer according to the first embodiment.
Figure 13:
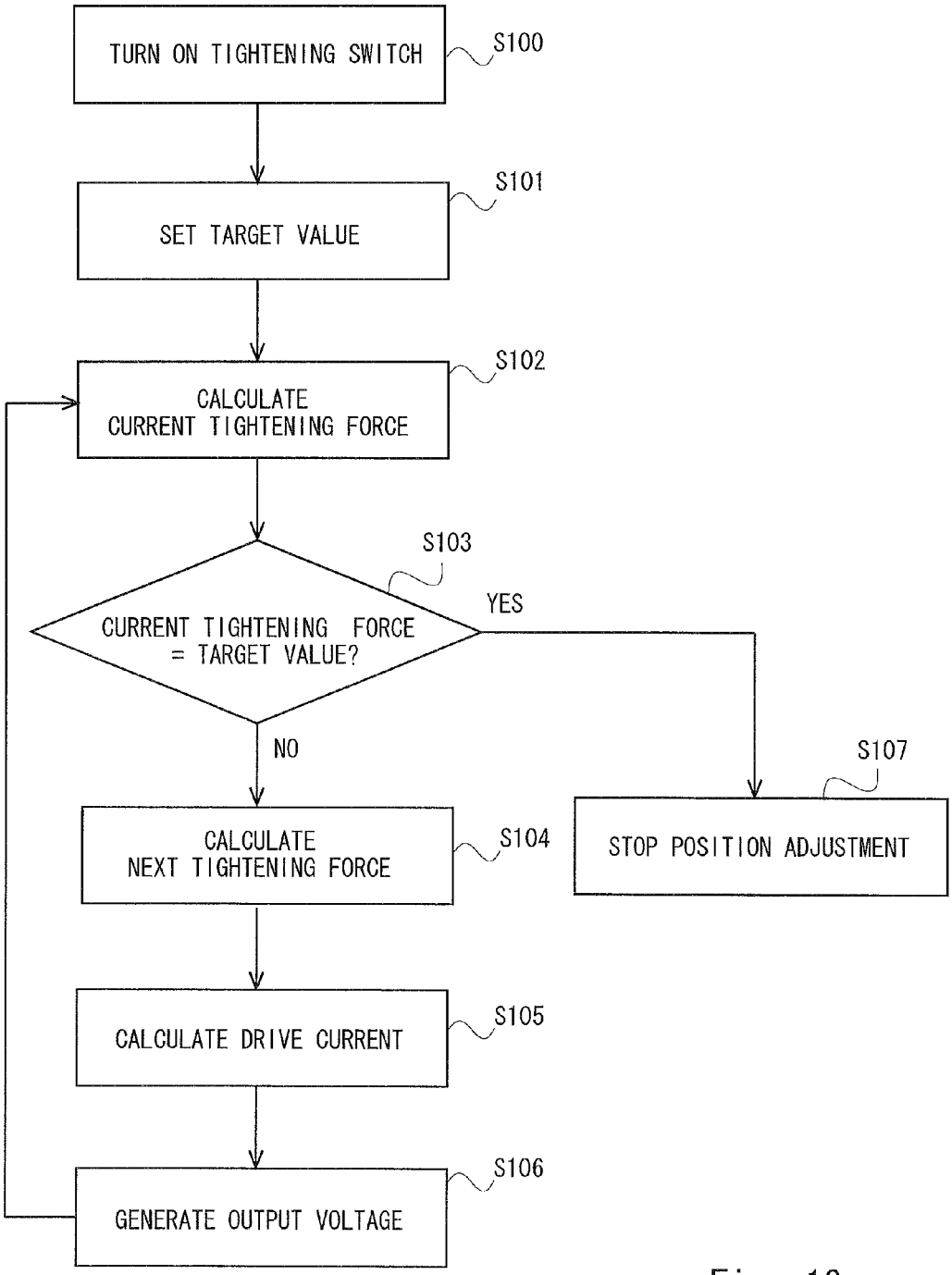
FIG. 13 is a schematic flowchart showing a tightening procedure according to the first embodiment.
Figure 14:
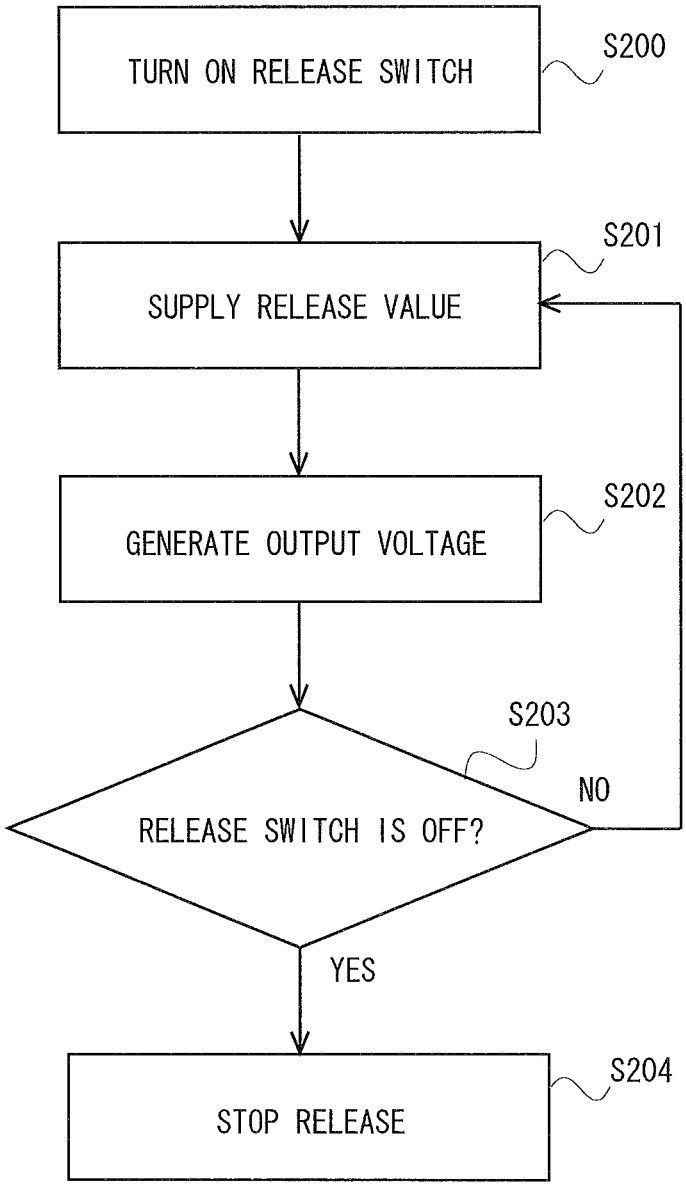
FIG. 14 is a schematic flowchart showing a releasing procedure according to the first embodiment.
Figure 15:
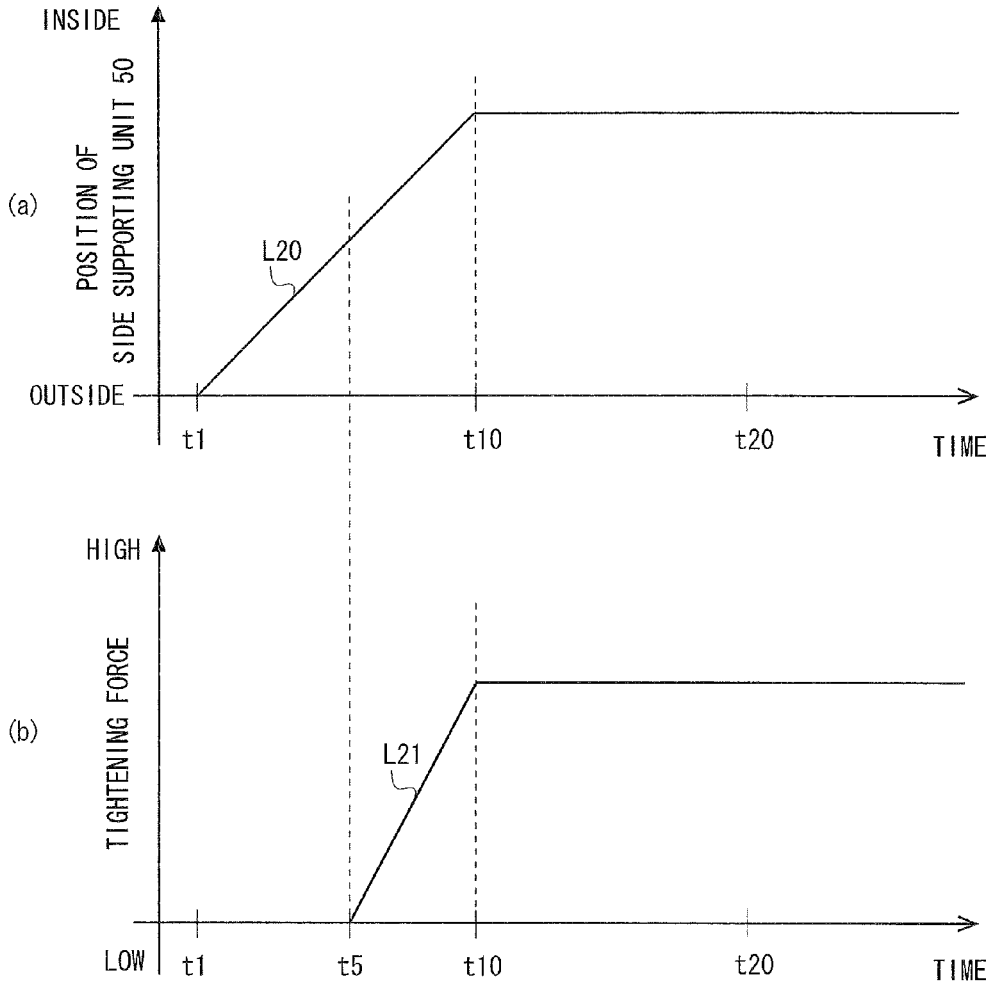
FIG. 15 is a schematic timing chart showing the relationship between displacement of the side supporting part and tightening force applied to a person being assisted according to the first embodiment.

Embodiments of the present invention will be described hereinbelow with reference to the drawings. FIGS. 1 and 2 are schematic perspective views of a transfer assistance device. FIGS. 3 and 4 are explanatory views illustrating the operation of the transfer assistance device. FIG. 5 is an explanatory view illustrating the structure of a side supporting part. FIG. 6 is a schematic view of the side supporting part when viewed from the z-axis. FIGS. 7 and 8 are schematic views showing the drive mechanism of the side supporting part. FIG. 9 is a table showing the relationship between tightening force and deviation. FIG. 10 is a table showing the relationship between tightening force and discomfort. FIG. 11 is a table showing the relationship between tightening force and deviation/discomfort. FIG. 12 is a schematic block diagram showing a configuration example of a computer. FIG. 13 is a schematic flowchart showing a tightening procedure. FIG. 14 is a schematic flowchart showing a releasing procedure. FIG. 15 is a schematic timing chart showing the relationship between displacement of the side supporting part and tightening force applied to a person being assisted.

As shown in FIG. 1, a transfer assistance device (movable body, delivery vehicle) 100 includes a bogie unit (body unit) 10, an arm unit (movable unit) 20, and a supporting unit (supporting element) 30. The transfer assistance device 100 has a bogie structure and can travel on a flat surface. The transfer assistance device 100 moves in accordance with the driving force generated by an electric motor built in its body. Note that, however, the transfer assistance device 100 may be configured to move in accordance with the pushing or pulling force of an assisting person. Thus, a drive source such as an electric motor may or may not be mounted on the transfer assistance device 100. Note that the specific way to implement the spatial mobility of the transfer assistance device 100 is arbitrary, and the spatial mobility may be implemented by a belt conveyor.

The bogie part 10 includes a base plate 11, wheel parts 12 to 15, a column 16, a rail 17, a sliding controller 18, a storage 19, and a seat 90. The arm unit 20 includes a slider 21, a handle (gripper) 22, and a link mechanism 23. The supporting unit 30 includes a front supporting part 40 and a set of side supporting parts 50 and 60. The front supporting part 40 and the side supporting parts 50 and 60 are mounted to support the torso of a person being assisted 150 from different directions. Note that the number of directions to support the torso of the person being assisted 150 by the supporting unit 30 is arbitrary and not limited to three directions as in this example.

The base plate 11 is a plate member that lies along the x-axis in the lengthwise direction. The base plate 11 is made up of a metal plate (steel plate etc.), for example. The base plate 11 has four corners, and the wheel parts 12 to 15 are attached at the respective corners of the base plate 11.

The wheel parts 12 and 13 function as main wheel parts. The wheel parts 14 and 15 function as auxiliary wheel parts. A wheel in the wheel part 12 and a wheel in the wheel part 13 rotate in accordance with the driving force transmitted from a motor. On the other hand, the driving force generated in the motor is not transmitted to a wheel in the wheel part 14 and a wheel in the wheel part 15. The wheels provided for the wheel parts 14 and 15 function as driven wheels.

The wheel part 12 includes a wheel 12*a*, an axle support 12*b*, and a wheel cover 12*c*. The rotation axis of the wheel 12*a* is pivotally supported by the axle support 12*b*. The axle support 12*b* is fixed to the wheel cover 12*c*. The wheel cover 12*c* is placed at the position to cover the wheel 12*a* from above and fixed to the base plate 11.

Like the wheel part 12, the wheel part 13 includes a wheel 13*a*, an axle support 13*b*, and a wheel cover 13*c*. The structure of the wheel part 13 is substantially the same as that of the wheel part 12 and not redundantly described.

The wheels 12*a* and 13*a* are arranged coaxially with the base plate 11 placed therebetween. The rotation axis of the wheel 12*a* is not common to the rotation axis of the wheel 13*a*. The wheel 12*a* and the wheel 13*a* are rotation-controlled separately from each other, which makes the rotary operation of the transfer assistance device 100 possible. Note that the axle support 12*b* that is supporting the wheel 12*a* may be made rotatable about the wheel cover 12*c*. In this case, the rotating direction of the wheel 12*a* can be controlled arbitrarily in the x-z plane.

Like the wheel part 12, the wheel part 14 includes a wheel 14*a*, an axle support 14*b*, and a wheel cover 14*c*, and the wheel part 15 includes a wheel 15*a*, an axle support 15*b*, and a wheel cover 15*c*. The structures of the wheel parts 14 and 15 are substantially the same as that of the wheel part 12 and not redundantly described.

The wheel parts 14 and 15 are arranged coaxially. The wheel 14*a* in the wheel part 14 functions as a driven wheel. The same applies to the wheel 15*a* in the wheel part 15. This stabilizes the movement of the transfer assistance device 100.

The column 16 is a columnar member that lies along the y-axis in the lengthwise direction and is provided to stand on the base plate 11. The column 16 is placed between the wheel parts 12 and 13. A specific structure of the column 16 is arbitrary. For example, the column 16 may be a hollow columnar member. In the column 16, an electric motor (drive source), a battery (power supply), lines, an electronic component, a transmission mechanism and the like are stored. The electric motor generates driving force in accordance with power supplied from the battery. The driving force generated in the electric motor is transmitted to the wheels in the wheel parts through the transmission mechanism.

The rail 17 is a projecting strip and mounted on the side surface of the column 16. The rail 17 lies in an arc on the x-y plane. The slider 21 of the arm unit 20 is attached to the rail 17. The posture of the arm unit 20 changes by being guided by the rail 17. Note that the rail 17 is preferably mounted on the other side surface of the column 16. A mechanism to guide the posture control of the arm unit 20 is arbitrary, and it can be implemented by a method different from a combination of the rail and the slider.

The sliding controller 18 controls the sliding of the slider 21 that slides over the rail 17. For example, the sliding controller 18 is engaged by friction with the slider 21 so that the slider 21 does not move over the rail 17 too fast. Further, the sliding controller 18 is engaged by friction with the slider 21 so as to fix the slider 21 onto the rail 17. Note that a specific method for the sliding controller 18 to control the movement of the slider 21 is arbitrary.

The storage 19 is a box-shaped member and mounted on the front surface of the column 16. In the storage 19, a mother board on which electronic components (CPU (Central Processing Unit), memory and hard disk) are mounted is stored, for example. For example, the CPU controls the driving of the above-described electric motor in accordance with execution of a program stored in the memory.

The seat 90 is mounted on the base plate 11 in such a way that its position is adjustable upward from the base plate 11. When the transfer assistance device 100 moves spatially, the person being assisted 150 who is being supported by the supporting unit 30 can be in a seated position, so that the physical burden placed on the person being assisted 150 during movement can be effectively reduced.

The arm unit 20 includes the slider 21, the handle 22 and the link mechanism 23. As is obvious from FIGS. 1 and 2, the arm unit 20 changes in shape, moving in an arc on the x-y plane. The supporting unit 30 is mounted at the front end of the arm unit 20. The base end of the arm unit 20 is supported by the column 16.

The slider 21 is engaged with the rail 17 and slides in an arc on the x-y plane by being guided by the rail 17. In order to smooth the movement of the slider 21, the slider 21 and the rail 17 may be engaged with each other through a ball or the like.

The handle 22 is a part that is gripped by an assisting person, and is joined to the slider 21. By mounting the handle 22 on the arm unit 20, it is possible to reduce the feeling of insecurity of the person being assisted 150 when the person being assisted 150 is lifted up. The change in posture of the arm unit 20 is adjustable by the assisting person who is gripping the handle 22. Because the person being assisted 150 is face to face with the assisting person, the intent of the person being assisted 150 can be easily grasped, and the assisting person can reduce the speed of posture change of the arm unit 20 according to the intent of the person being assisted 150, for example. This effectively reduce the feeling of insecurity of the person being assisted 150 when lifted up.

The link mechanism 23 is engaged with the slider 21 and changes in posture in accordance with the sliding operation of the slider 21. The base end of the link mechanism 23 is engaged with the slider 21, and the front end of the link mechanism 23 is engaged with the supporting unit 30. Because the link mechanism 23 is placed between the slider 21 and the supporting unit 30, the supporting unit 30 can be displaced as intended. This allows the supporting unit 30 to be displaced in a natural manner. A specific structure of the link mechanism 23 is arbitrary. The number of joints included in the link mechanism 23 is arbitrary and not limited to two as shown in the figure.

The supporting unit 30 includes a front supporting part (main supporting part) 40, a side supporting part (sub supporting part) 50, a side supporting part (sub supporting part) 60, a joint part 70, and a joint part 80.

The front supporting part 40 is mounted corresponding to the front side (principal plane) of the torso of the person being assisted 150. The front supporting part 40 has the size to support the torso of a person (which is a part from the upper end of the chest to the anterior superior iliac spine, for example) overall. The front supporting part 40 supports the torso of the person being assisted 150 overall.

The side supporting parts 50 and 60 are mounted corresponding to the sides of the torso of the person being assisted 150. The side supporting parts 50 and 60 are provided in the form to support the sides of the torso of a person. The side supporting parts 50 and 60 support the person being assisted 150 leaning on the front supporting part 40 by pressing from the sides. The front supporting part 40, the side supporting parts 50 and 60 and the like support the chest of the person being assisted 150 from three directions in cooperation with one another, thereby supporting the person being assisted 150 more stably.

Note that the side supporting part 50 is attached to the front supporting part 40 through the joint part 70. The side supporting part 60 is attached to the front supporting part 40 through the joint part 80.

The front supporting part 40 includes a base plate 41, a cushioning 42 and a storage 43. The base plate 41 is covered with the cushioning 42. This reduces the pain or the like suffered by the person being assisted 150 when the person being assisted 150 leans on the front supporting part 40. The base ends of the joint parts 70 and 80 are attached to the storage 43. Note that the cushioning is formed by covering an interior cushioning material with a cover sheet (covering material, skin material). Like the front supporting part 40, the side supporting part 50 includes a base plate and a cushioning. The same applies to the side supporting part 60.

The operation of the transfer assistance device is described hereinafter with reference to FIGS. 3 and 4. FIG. 3 corresponds to the transfer assistance device 100 in the posture shown in FIG. 1. FIG. 4 corresponds to the transfer assistance device 100 in the posture shown in FIG. 2.

First, as schematically shown in FIG. 3, the transfer assistance device 100 is placed at the position where the person being assisted 150 can hug the supporting unit 30. The person being assisted 150 leans on the front supporting part 40. When a tightening switch is switched on by an assisting person, the transfer assistance device 100 starts the position adjustment operation of the side supporting parts 50 and 60. The transfer assistance device 100 propels the side supporting parts 50 and 60 toward the person being assisted 150 in accordance with an instruction to start tightening by the assisting person. When the tightening force acting on the person being assisted 150 by the side supporting parts 50 and 60 becomes equal to the tightening force previously set as a target value (which is referred to hereinafter simply as target tightening force in some cases), the transfer assistance device 100 stops the propulsion drive of the side supporting parts 50 and 60. The person being assisted 150 is thereby held by the side supporting parts 50 and 60 from both sides in the posture of leaning on the front supporting part 40, so that the position is fixed onto the front supporting part 40.

In this embodiment, as is obvious from the description below, the transfer assistance device 100 detects a pressure proportional to the propulsion of the side supporting part 50 and the counterforce generated by contact of the side supporting part 50 with the person being assisted 150 and, based on the detected pressure, adjusts the positions of the side supporting parts 50 and 60 so that the tightening force on the person being assisted 150 by the side supporting part 50 becomes closer to the target tightening force. When the current tightening force reaches the target tightening force, the displacement of the side supporting parts 50 and 60 stops, and their positions are fixed. By such control, it is possible to appropriately support the persons being assisted 150 with different body types with the tightening force sufficient to prevent coming-off in such a manner to reduce the discomfort felt by the person being assisted 150.

Next, the transfer assistance device 100 lifts the person being assisted 150 by displacing the supporting unit 30 in the state where the person being assisted 150 is adequately supported by the supporting unit 30. By the lifting operation of the transfer assistance device 100, it becomes the state schematically shown in FIG. 4. As schematically shown in FIG. 4, the arm angle of the arm unit 20 changes so that the supporting surface of the front supporting part 40 becomes facing upwards from facing sideways, and thereby the person being assisted 150 is lifted.

The operation to lift up the person being assisted 150 by the transfer assistance device 100 is executed by the driving force generated in an internal motor, for example. When lifting the person being assisted 150, the slider 21 slides over the rail 17 from up to down. In accordance with the sliding operation of the slider 21, the handle 22 is displaced. Likewise, the link mechanism 23 is displaced in accordance with the sliding operation of the slider 21. By such cooperation, the posture of the supporting unit 30 changes from the state shown in FIG. 3 to the state shown in FIG. 4. The person being assisted 150 in the posture of being supported by the supporting unit 30 is thereby lifted upward from a bed. Note that the operation to lift down the person being assisted 150 is obvious from the above description and not redundantly described.

A specific structure of the supporting unit 30 is described hereinafter with reference to FIGS. 5 and 6. It is assumed that the xyz coordinates are set as shown in FIG. 5. The z-axis coincides with the lengthwise direction of a supporting surface (front surface, principal surface) 44 of the front supporting part 40. The x-axis coincides with the direction of going away from the supporting surface 44 of the front supporting part 40. The y-axis coincides with the crosswise direction of the supporting surface 44 of the front supporting part 40. Note that the x-axis, y-axis and z-axis are orthogonal to one another. Note that the lengthwise direction of the front supporting part 40 coincides with the direction of a thoracic vertebra of the person being assisted 150 being supported by the supporting unit 30. The xyz coordinates shown in FIG. 5 are applied also to the subsequent drawings.

As shown in FIG. 6, the side supporting parts 50 and 60 are configured to be movable along the axis line LX10. As is obvious from FIG. 6, the axis line LX10 is an axis line parallel to the z-y plane. The axis line LX20 is an axis line orthogonal to the axis line LX10 and lies in parallel to the x-axis.

As schematically shown in FIG. 6, the side supporting parts 50 and 60 have a shape that is recessed to fit the outer shape of the torso of the person being assisted 150 in the posture of leaning on the front supporting part 40. In other words, an inner surface (supporting surface) 51 of the side supporting part 50 has a recess 52. Because the inner surface 51 of the side supporting part 50 has the recess 52, the sufficient contact area with the side of the torso of the person being assisted 150 can be obtained. It is thereby possible to press and support the person being assisted 150 more stably. Like the side supporting part 50, an inner surface 61 of the side supporting part 60 has a recess 62. Note that the recesses 52 and 62 are concave parts with the depth along the y-axis direction and lie along the z-axis direction.

The driving structure and the driving operation of the side supporting parts 50 and 60 are described hereinafter with reference to FIGS. 7 to 15.

As schematically shown in FIG. 7, the side supporting part 50 is joined to the front supporting part 40 through the joint part 70. The joint part 70 includes an arm 71, a guide rail 72, a slider 73, and a slider 74. The arm 71 is attached movably to the guide rail 72 through the sliders 73 and 74. The guide rail 72 is a rail lying along the y-axis and fixed to the front supporting part 40. The sliders 73 and 74 function also as stoppers and fix the position of the arm 71 with respect to the guide rail 72.

Note that the arm 71 includes arm parts 71*a* to 71*d*. The arm part 71*a* is a bar-like part extending linearly along the y-axis. The arm part 71*b* is a bar-like part extending linearly along the x-axis. The arm parts 71*c* and 71*d* are bar-like parts extending linearly along the y-axis. The arm parts 71*c* and 71*d* extend substantially parallel to the arm part 71*a*. The arm part 71*a* is provided with a rack 71*e*.

As schematically shown in FIG. 7, the transfer assistance device 100 includes a force sensor (pressure detection unit) 91, a driving unit 92, and a computer (control unit) 93. The driving unit 92 includes an amplifier 92*a*, a motor 92*b*, a rotation axis 92*c*, a gear 92*d*, and a pinion 92*e*. The computer 93 calculates the current tightening force from a detected value of the force sensor 91 and controls the driving of the driving unit 92 in such a way that the current tightening force becomes equal to the target tightening force. It is thereby possible to support each person being assisted 150 with appropriate tightening force.

The driving unit 92 includes a transmission mechanism composed of mechanical elements such as a gear, a pinion and a rack. The gear 92*d* is placed to engage with the pinion 92*e*. The pinion 92*e* is placed to engage with the rack 71*e* mounted on the arm part 71*a*. The use of such a transmission mechanism allows displacement of the arm 71 along the y-axis in accordance with the torque generated by the motor 92*b*. When the gear 92*d* rotates about the axis line AX11 as the rotation axis in accordance with the torque generated by the motor 92*b*, the pinion 92*e* rotates about the axis line AX10 as the rotation axis. The arm 71 is displaced along the y-axis in accordance with the rotation of the pinion 92*e*. In synchronization with the movement of the arm 71, the side supporting part 50 is displaced along the y-axis.

The force sensor 91 is placed between the arm part 71*c* and the arm part 71*d* and detects a pressure proportional to propulsion F1 and counterforce F2 generated on the axis line AX12 schematically shown in FIG. 7. The propulsion F1 and the counterforce F2 are generated when the arm 71 moves inward in accordance with the counterclockwise rotation of the pinion 92*e*, with the side supporting part 50 in contact with the person being assisted 150. In the state where the side supporting part 50 is not in contact with the person being assisted 150, the counterforce F2 is not generated and the output value of the force sensor 91 is substantially zero (note that, although the force sensor 91 detects a pressure proportional to the inertial force of the side supporting part 50, the detected value is ignored).

A specific structure of the force sensor 91 is arbitrary. Preferably, a strain gauge is used as the force sensor 91. Various types of strain gauges are known, and any type of strain gauge may be used. For example, the strain gauge is configured by forming a lattice-like resistance wire on an insulating substrate and providing a leading wire therefor. The resistance value of the resistance wire included in the strain gauge increases and decreases according to the pressure proportional to the forces F1 and F2. The strain gauge outputs a value S1 in accordance with a change in the resistance value of the resistance wire to the computer 93. A circuit that performs processing including analog-to-digital conversion is placed between the strain gauge and the computer. An analog detected value of the strain gauge is converted into a digital signal and input to the computer. Note that the force sensor 91 may be configured by combining a spring and a sensor that detects a displacement of the spring.

The computer 93 controls the driving unit based on the output value of the force sensor 91 so that the current tightening force reaches the target tightening force. Note that the computer 93 is an information processing device that implements various functions by execution of a program by the CPU (Central Processing Unit).

The computer 93 preferably operates as follows. First, the computer 93 calculates the current tightening force based on the output value of the force sensor 91. Next, the computer 93 calculates the next tightening force based on the current tightening force and the target tightening force. Then, the computer 93 calculates a current value to be applied to the motor based on the next tightening force. Then, the computer 93 calculates an amplifier input voltage required to obtain the calculated current value. The driving unit 92 performs driving based on the amplifier input voltage supplied from the computer 93. Note that a specific structure of the computer 93 is arbitrary and not limited to the above-described operating structure.

The amplifier 92*a* amplifies the voltage supplied from the computer 93 and outputs it. The current in accordance with the supply voltage from the amplifier 92*a* flows into the motor 92*b*, and thereby the rotation axis 92*c* rotates, the gear 92*d* rotates, the pinion 92*e* rotates, and the arm 71 moves.

The cooperation between the joint part 70 and the joint part 80 is described with reference to FIG. 8. As shown in FIG. 8, a transmission mechanism (to be more clearly, the pinion 92*e*) that is common between the joint part 70 and the joint part 80 is used. This simplifies the structure of the transmission mechanism for driving the arm and downsizes the driving unit of the transfer assistance device.

As shown in FIG. 8, the joint part 80 has the same structure as the joint part 70. Specifically, the joint part 80 includes an arm 81, a guide rail 82, a slider 83, and a slider 84. The arm 81 corresponds to the arm 71, the guide rail 82 corresponds to the guide rail 72, the slider 83 corresponds to the slider 73, and the slider 84 corresponds to the slider 74. Thus, the redundant explanation thereof is omitted. Note that the force sensor 91 is not mounted on the arm 81, differently from the arm 71. Thus, the arm part 81*b* and the side supporting part 60 are directly joined by the arm part 81*c*.

The arm part 81*a* of the arm 81 is provided with a rack 81*e*. The pinion 92*e* slides over the rack 81*e* of the arm part 81*a*. When the pinion 92*e* rotates clockwise, the arms 71 and 81 move inward. When the pinion 92*e* rotates counterclockwise, the arms 71 and 81 move outward. In accordance with the inward movement of the arms 71 and 81, the person being assisted 150 on the front supporting part 40 is held between the side supporting parts 50 and 60. In accordance with the outward movement of the arms 71 and 81, the person being assisted 150 on the front supporting part 40 is released from the state of being held between the side supporting parts 50 and 60.

Setting of the tightening force on the person being assisted 150 by the side supporting parts 50 and 60 is described hereinafter with reference to FIGS. 9 to 11. As shown in FIG. 9, as the tightening force becomes stronger, the deviation of the person being assisted 150 becomes smaller as indicated by the line L50. It is preferred to have the deviation of a threshold TH1 or less for the lifting of the person being assisted. As shown in FIG. 10, as the tightening force becomes stronger, the discomfort of the person being assisted 150 becomes worse as indicated by the line L60. The discomfort is preferably a threshold TH2 or less in order to reduce the discomfort felt by the person being assisted to an allowable level.

The lifting of the person being assisted 150 by the transfer assistance device 100 is preferably made in such a manner to prevent the person being assisted 150 from coming off the side supporting parts 50 and 60 of the transfer assistance device 100. Thus, the lifting operation can be made more reliably with strong tightening force than weak tightening force.

However, the strong tightening force can cause the person being assisted 150 to feel uncomfortable. It is therefore preferred to apply the tightening force that does not cause the person being assisted 150 to feel uncomfortable. Thus, the tightening force within the range of R10 which is schematically shown in FIG. 11 is preferred. However, when the side supporting parts 50 and 60 are fixed, it is difficult to apply appropriate tightening force to each person being assisted 150 due to variations in the body shape of the person being assisted 150, variations in the state of wearing clothes of the person being assisted 150 and the like. For example, the appropriate tightening force suitable for the person being assisted 150 with the waist of 80 cm is not suitable for the person being assisted 150 with the waist of 100 cm, and the discomfort felt by the person being assisted 150 is not allowable.

In this embodiment, it is possible to make feedback control of the tightening of the person being assisted 150 by the side supporting parts 50 and 60 based on the detected value of the force sensor 91 so that appropriate tightening force is applied to each person being assisted 150. It is thereby possible to accommodate variations in body shape, variations in clothes worn and the like and support each person being assisted 150 with appropriate tightening force (the tightening force within the range of R11 shown in FIG. 11). This is because the holding force required to support a person being assisted is different depending on the weight of the person. It is thus possible to support the person being assisted 150 in such a manner to reduce the discomfort felt by the person being assisted 150 and prevent the person being assisted 150 from coming off the transfer assistance device.

In the case of Patent Literature 1, because the shape of the supporting member such as the underarm supporting arm (the reference symbol 29D in FIG. 5 of Patent Literature 1) is predetermined, variations in body shape among persons being assisted cannot be accommodated, which makes it difficult to suitably support each person being assisted. In the case of Patent Literature 2, although the state of contact area of the supporting element with a person's body is controlled by feedback control, it is irrelevant to a mechanism to tighten and support a person being assisted.

An example of the structure of the transfer assistance device 100 is described hereinafter with reference to FIGS. 12 to 15. Note that FIGS. 12 to 15 are provided by way of illustration only, and thus are not to be considered as limiting the present invention.

As shown in FIG. 12, a force sensor 91, a tightening switch 94 and a release switch 95 are connected to the computer 93, and their outputs are input to the computer 93. The computer 93 includes a target value supply unit 93*a*, a current tightening force calculation unit 93*b*, a next tightening force calculation unit 93*c*, a drive current calculation unit 93*d*, an output voltage generation unit 93*e*, and a release value supply unit 93*f*. Note that the next tightening force calculation unit 93*c* functions also as a determination unit. The computer 93 is a typical calculator and is composed of a CPU (Central Processing Unit), a hard disk, a memory and the like. The computer 93 exercises various functions by execution of a program by the CPU. For example, the above-described calculation unit or the like is implemented by execution of a program by the CPU.

The output of the tightening switch 94 is connected to the target value supply unit 93*a*. The output of the force sensor 91 is connected to the current tightening force calculation unit 93*b*. The output of the target value supply unit 93*a* and the output of the current tightening force calculation unit 93*b* are supplied individually to the next tightening force calculation unit 93*c*. The output of the next tightening force calculation unit 93*c* is connected to the drive current calculation unit 93*d*. The output of the drive current calculation unit 93*d* is connected to the output voltage generation unit 93*e*. The output of the release switch 95 is connected to the release value supply unit 93*f*. The output of the release value supply unit 93*f* is connected to the output voltage generation unit 93*e*. The output of the output voltage generation unit 93*e* is connected to the amplifier 92*a*. The tightening switch 94 and the release switch 95 are preferably placed at the position where an assisting person can easily press (for example, on the side supporting part or the like).

The operation of the computer 93 during tightening operation briefly described. When the tightening switch 94 is turned on, the target value supply unit 93*a* supplies a target value corresponding to the target tightening force to the next tightening force calculation unit 93*c*. For example, the target value supply unit 93*a* includes a resistor to store the target value and outputs the stored value of the resistor. Upon contact of the side supporting parts 50 and 60 with the person being assisted 150, the force sensor 91 detects a pressure proportional to the propulsion and the counterforce described above. Upon input of the detected value of the force sensor 91, the current tightening force calculation unit 93*b*calculates the current tightening force applied to the person being assisted 150 by the side supporting parts 50 and 60. The next tightening force calculation unit calculates the next tightening force based on the target tightening force supplied from the target value supply unit 93*a* and the current tightening force supplied from the current tightening force calculation unit 93*b*. Note that, when the side supporting parts 50 and 60 are not in contact with the person being assisted 150, the signal that is output from the current tightening force calculation unit 93*b* indicates that the current tightening force=0.

The next tightening force calculation unit 93*c* performs an arithmetical operation as follows, for example. When the target tightening force is f_ref and the current tightening force is f_n, the next tightening force f is calculated by the following operational expression: f=f_ref+k(f_ref−f_n), where k is a positive value. The drive current calculation unit 93*d* calculates a current value to be supplied to the motor based on the calculated next tightening force. The output voltage generation unit 93*e* generates a voltage required to obtain the calculated current value.

When the current tightening force that is supplied from the current tightening force calculation unit 93*b* becomes equal to the target tightening force that is supplied from the target value supply unit 93*a*, f=f_ref is satisfied. When f=f_ref, the drive current calculation unit 93*d* calculates that the current value=0 so that no current flows into the motor 92*b*. When the current value=0, the output voltage generation unit 93*e* generates the voltage value=0 so that no current flows into the motor 92*b*. In this manner, the determination unit 93*c* determines that the current tightening force supplied from the current tightening force calculation unit 93*b* is equal to the target tightening force supplied from the target value supply unit 93*a*. Then, the drive current calculation unit 93*d* and the output voltage generation unit 93*e* operate so as not to let the current flow into the motor 92*b*. The side supporting parts 50 and 60 thereby stop moving toward the person being assisted 150, and the side supporting parts 50 and 60 are fixed on the spot. The side supporting parts 50 and 60 are configured to be fixed on the spot without being affected by the counterforce from the person being assisted 150.

The operation of the computer 93 during release operation is briefly described. When the release switch is turned on, the release value supply unit 93*f* supplies a predetermined current value to the output voltage generation unit 93*e*. The output voltage generation unit 93*e* generates a voltage required to obtain the supplied current value. The side supporting parts 50 and 60 thereby come away from the person being assisted 150 at a constant speed. During the period when the release switch is on, the release operation that the side supporting parts 50 and 60 come away from the person being assisted 150 continues.

The tightening operation is described hereinafter with reference to FIG. 13. First, the tightening switch 94 turns on (S 100). Next, a target value is set (S101). Specifically, the target value supply unit 93*a* outputs a target value that is obtained experimentally. Then, current tightening force is calculated (S102). Specifically, the current tightening force calculation unit 93*b* calculates the current tightening force based on the output value of the force sensor 91. Then, it is determined whether the current tightening force is equal to the target value (S103). The detection whether the current tightening force is equal to the target value is executed by the operation of the next tightening force calculation unit as described above.

When the current tightening force is not equal to the target value, next tightening force is calculated (S104). Specifically, the next tightening force calculation unit 93*c* calculates the next tightening force based on the target value and the current tightening force. Then, a drive current is calculated (S105). Specifically, the drive current calculation unit 93*d* calculates a current value required to achieve the next tightening force. Then, an output voltage is generated (S106). Specifically, the output voltage generation unit 93*e* generates a voltage required to apply the calculated current value to the motor 92*b*. The generated voltage is applied to the amplifier 92*a*, and the current with the calculated value is supplied to the motor 92*b*, and thereby the calculated tightening force is applied to the person being assisted 150. When the current tightening force is equal to the target value, the position adjustment of the side supporting parts 50 and 60 is stopped (S107). Note that the current tightening force is enough to be included in the range of R10 shown in FIG. 11. Thus, it may be detected whether the current tightening force is included in the range of R10 rather than detecting whether the current tightening force has reached the target value.

The release operation is described with reference to FIG. 14. Note that, when the release switch is pressed when the tightening operation is going on, the release operation is carried out in preference to the tightening operation. User's reliability on the transfer assistance device 100 can be thereby obtained.

First, the release switch is on (S200). Next, a release value is supplied (S201). Specifically, the release value supply unit 93*f* supplies a predetermined current value as the release value to the output voltage generation unit 93*e*. Then, an output voltage is generated (S202). Specifically, the output voltage generation unit 93*e*generates the output voltage required to obtain the supplied current value. Then, it is determined whether the release switch has turned off (S203). When the release switch becomes off, the release value supply unit 93*f* stops supplying the release value. The release operation thereby stops (S204). Although the release operation is executed by keeping the release switch on, it is not limited thereto, and the side supporting parts 50 and 60 may be released to a certain width by one push of the release switch.

The relationship between the displacement of the side supporting part 50 and the tightening force is described hereinafter with reference to FIG. 15. Note that the displacement of the side supporting part 60 is the same as the displacement of the side supporting part 50.

At time t1, the side supporting part 50 starts changing its position toward the person being assisted 150. At time t5, the side supporting part 50 comes into contact with the person being assisted 150. Upon contact of the side supporting part 50 with the person being assisted 150, the force sensor 91 detects a pressure proportional to the propulsion F1 and the counterforce F2. The computer 93 controls the driving unit 92 so that the current tightening force indicated by the detected value of the force sensor 91 becomes equal to tightening force set as the target tightening force. At time t10, the current tightening force reaches the target tightening force. The computer 93 detects that and stops displacement of the side supporting parts 50 and 60 by the driving unit 92. Note that the driving may be stopped when it is detected that the current tightening force is included in a predetermined range, rather than when it is detected that the current tightening force has reached the target tightening force as described above.

In this embodiment, the transfer assistance device 100 detects a pressure proportional to the propulsion of the side supporting part 50 and the counterforce generated by contact of the side supporting part 50 with the person being assisted 150 and, based on the detected the pressure, adjusts the positions of the side supporting parts 50 and 60 so that the tightening force on the person being assisted 150 by the side supporting part 50 becomes closer to the target tightening force. When the current tightening force reaches the target tightening force, the displacement of the side supporting parts 50 and 60 stops, and their positions are fixed. By such control, it is possible to appropriately support the person being assisted 150 with the tightening force sufficient to prevent coming-off in such a manner to reduce the discomfort felt by the person being assisted 150.

Note that, in the case of not using a drive system common to the side supporting parts 50 and 60, the force sensor 91 mounted on the side supporting part 50 needs to be mounted also on the side supporting part 60 to construct a feedback system similar to that of the side supporting part 50.

Second Embodiment

Figure 16:
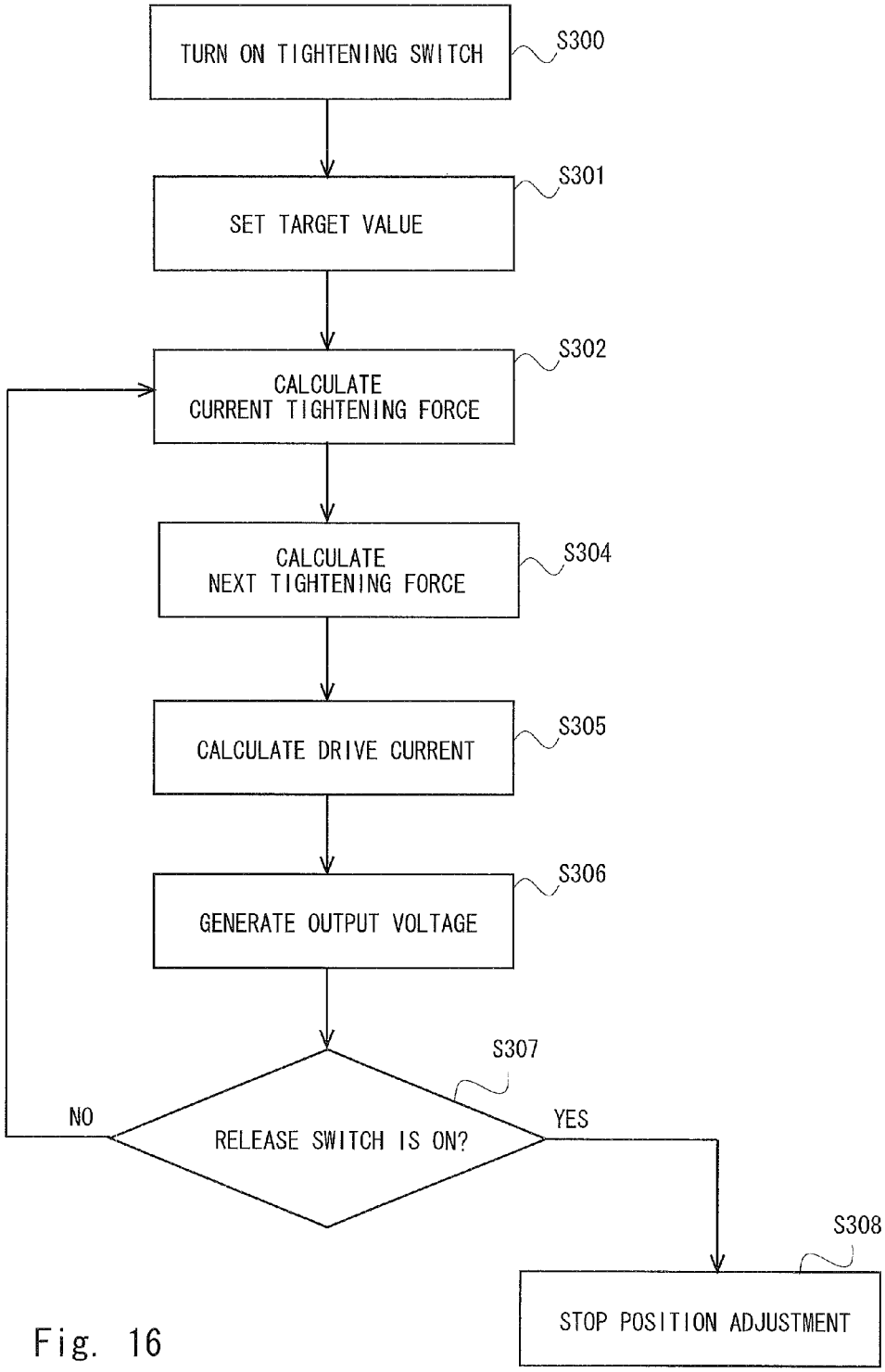
FIG. 16 is a schematic flowchart showing a tightening procedure according to a second embodiment.
Figure 17:
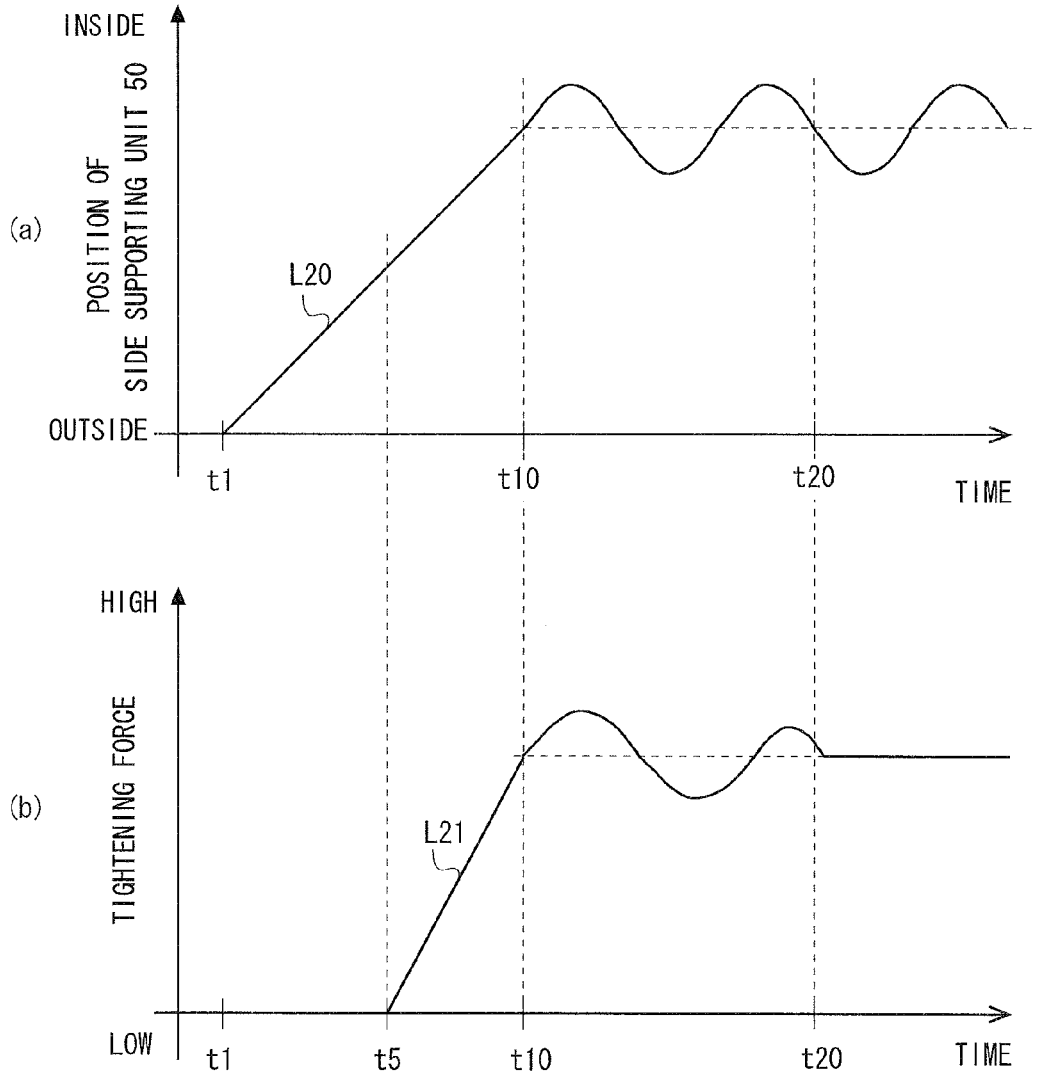
FIG. 17 is a schematic timing chart showing the relationship between displacement of the side supporting part and tightening force according to the second embodiment.

A second embodiment is described hereinafter with reference to FIGS. 16 and 17. FIG. 16 is a schematic flowchart showing a tightening procedure. FIG. 17 is a schematic timing chart showing the relationship between displacement of the side supporting part and tightening force.

In this embodiment, differently from the first embodiment, after starting the tightening operation, feedback control continues until the release switch is turned on. In this procedure, even if the state of the person being assisted 150 who is tightened changes, the operation to support the person being assisted 150 with appropriate tightening force can be maintained. As a specific example, it is possible to keep constant tightening force by accommodating variations in the torso shape of the person being assisted 150 in accordance with breathing of the person being assisted 150, so that the person being assisted 150 can be tightened and supported with more comfortable conditions. Besides, it is possible to maintain appropriate tightening force by accommodating the consequences of deviation of the trunk position of the person being assisted 150 in the process of transfer. Note that an assisting person turns on the release switch in the posture where a person being assisted is seated on a place to be transferred (for example, a bed, a wheelchair, a toilet seat or the like) as shown in FIG. 3.

As shown in FIG. 16, the loop of Steps S302 to S306 is blocked by turning-on of the release switch. When the release switch is turned on (S307), the position adjustment of the side supporting parts 50 and 60 is stopped (S308). Note that Steps 300 to 306 are the same as Steps 100 to 106 shown in FIG. 13 and not redundantly described.

As shown in FIG. 17, after time t10 when the target tightening force is achieved, the side supporting part 50 is displaced by vibration, repeating approaching and separating to and from the person being assisted 150. The displacement of the side supporting part 50 is in synchronization with breathing of the person being assisted 150. Thus, after time t20, constant tightening force is obtained. Note that the period from time t10 to time t20 is an adjustment period for obtaining the target tightening force.

In this embodiment, a control loop including Steps S302 to S306 is circulated in such a way that appropriate tightening force is kept after the target tightening force is obtained. It is thereby possible to maintain the operation to support the person being assisted 150 with appropriate tightening force even when the state of the person being assisted 150 who is tightened varies. As a specific example, it is possible to keep appropriate tightening force even when the torso shape of the person being assisted 150 varies with breathing of the person being assisted 150. The same applies when deviation of the trunk position of the person being assisted 150 or the like occurs in the process of transfer. It is thus possible to effectively reduce the stress felt by the person being assisted in the process from the state shown in FIG. 3 to the state shown in FIG. 4.

Third Embodiment

Figure 18:
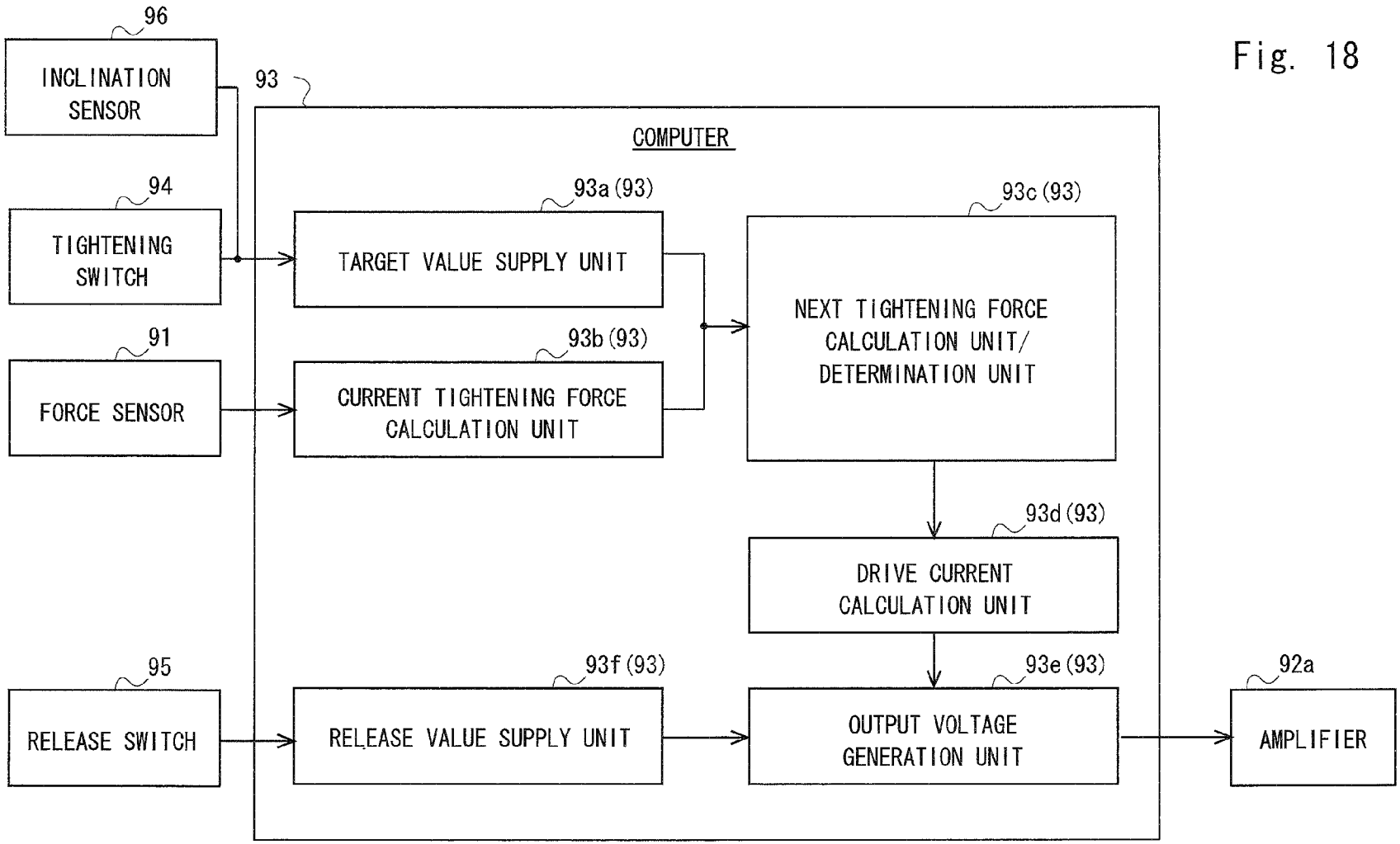
FIG. 18 is a schematic block diagram showing a configuration example of a computer according to a third embodiment.
Figure 19:
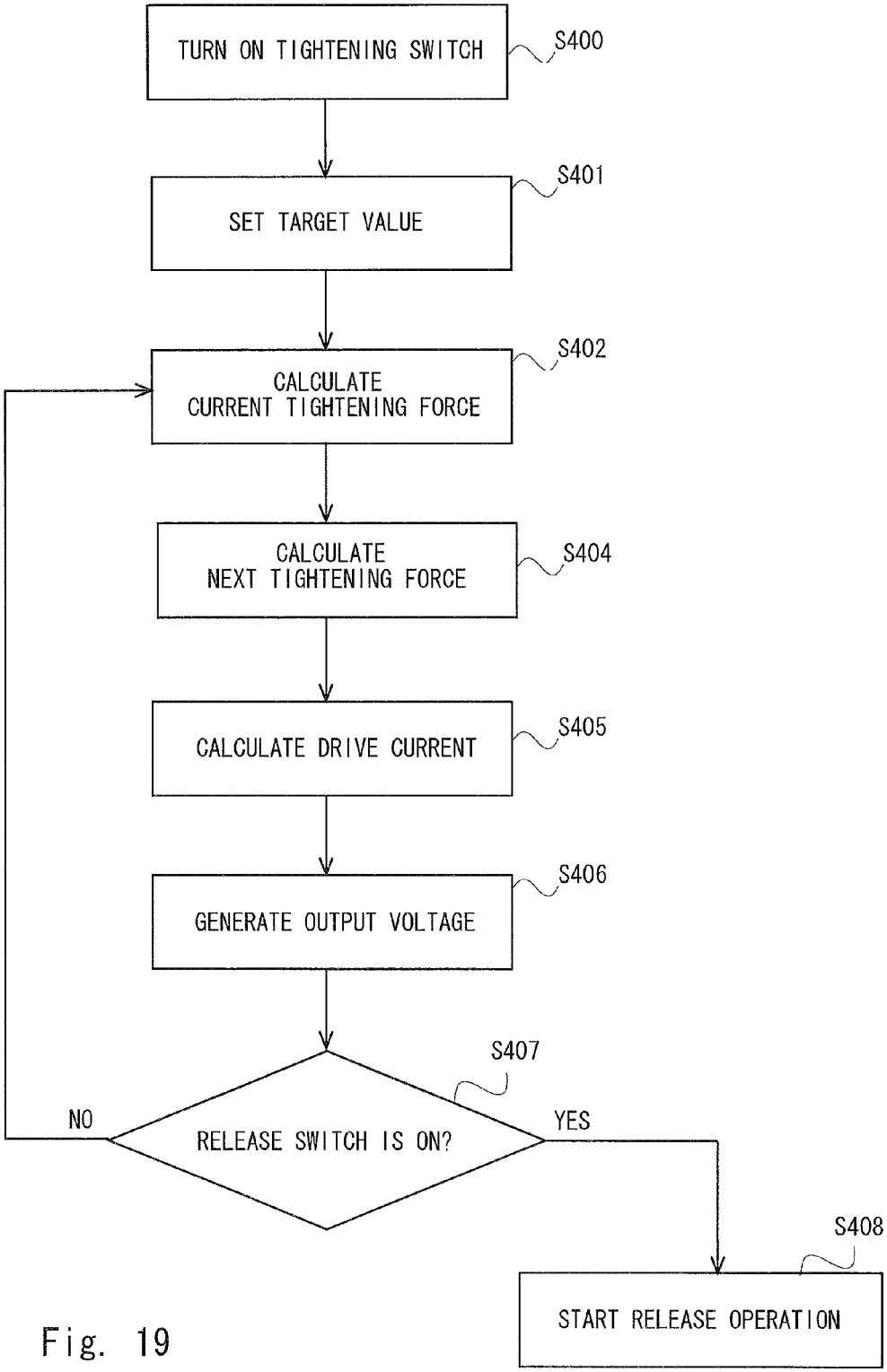
FIG. 19 is a schematic flowchart showing a tightening procedure according to the third embodiment.
Figure 20:
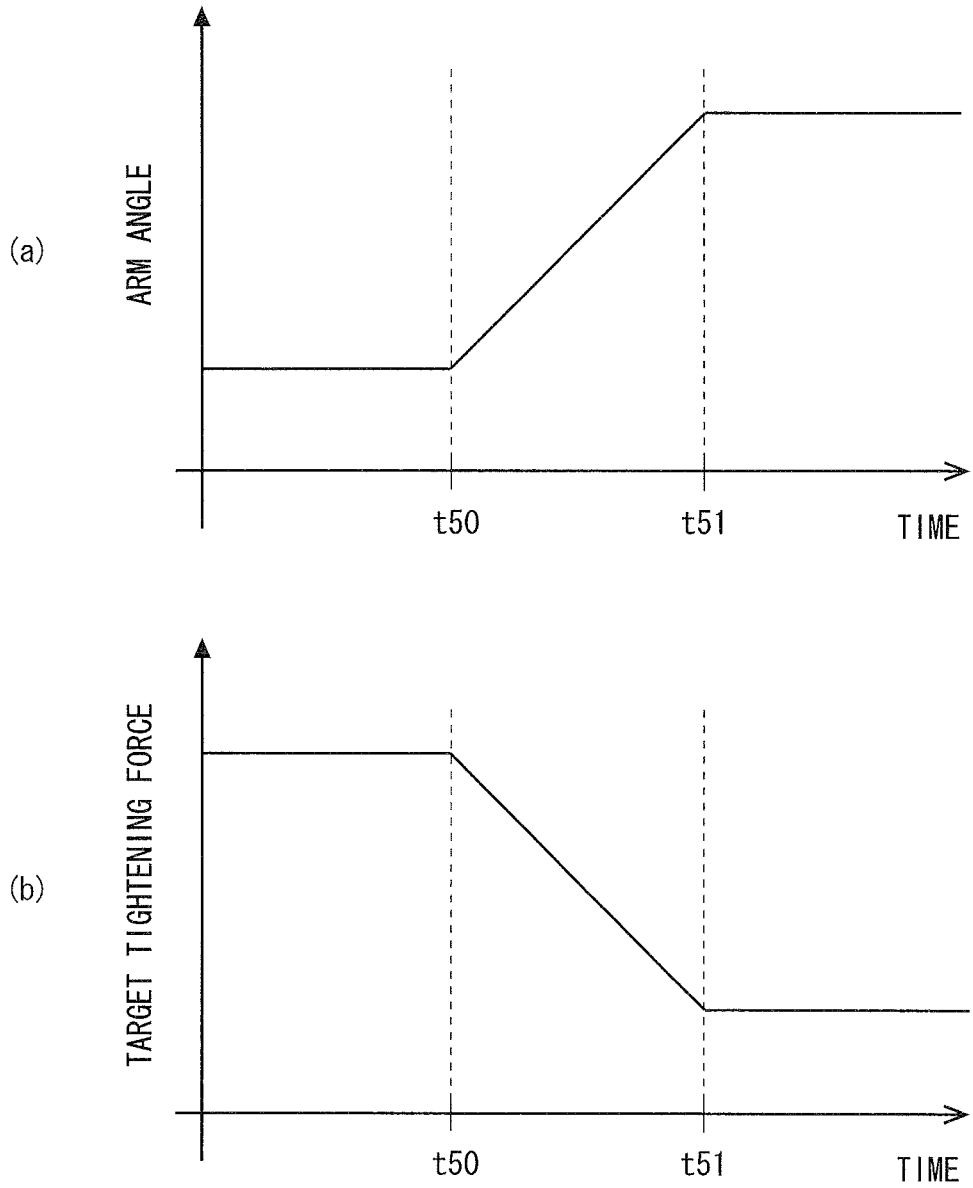
FIG. 20 is a timing chart showing the relationship between a target value and an arm angle according to the third embodiment.

A third embodiment is described hereinafter with reference to FIGS. 18 to 20. FIG. 18 is a schematic block diagram showing a configuration example of a computer. FIG. 19 is a schematic flowchart showing a tightening procedure. FIG. 20 is a timing chart showing the relationship between target tightening force and an arm angle.

In this embodiment, differently from the second embodiment, the target tightening force is reduced in accordance with an increase in arm angle (θ50 which is schematically shown in FIG. 4) (see FIG. 20). As the person being assisted 150 is lifted, the person being assisted 150 changes from the posture of leaning on the front supporting part 40 into the posture of resting totally on the front supporting part 40. When the person being assisted 150 is leaning on the front supporting part 40, it is required to tighten the person being assisted 150 more sufficiently by the side supporting parts 50 and 60 in order to prevent the person from coming off the front supporting part 40. On the other hand, when the person being assisted 150 is resting totally on the front supporting part 40, the possibility that the person being assisted 150 comes off the front supporting part 40 decreases. In light of this, in this embodiment, the target tightening force is reduced in accordance with an increase in arm angle. It is thus possible to lift the person being assisted 150 in such a manner to reduce the discomfort given to the person being assisted 150 compared to the case of the second embodiment.

As shown in FIG. 18, the output of an inclination sensor 96 is input to the computer 93. The output of the inclination sensor 96 is connected to the target value supply unit 93*a*. The target value supply unit 93*a* supplies the target tightening force in accordance with the angle of inclination. Note that the arm angle is detected as a way of detecting the transition from the state shown in FIG. 3 to the state shown in FIG. 4. However, there are various ways of detecting such state transition, and it is not limited to the detection of the arm angle. The transition from the state shown in FIG. 3 to the state shown in FIG. 4 may be detected based on the absolute position of the supporting unit 30.

As shown in FIG. 19, after the tightening switch is turned on, a target value is set (S402). Specifically, the target value supply unit 93*a* supplies the target value in accordance with the angle of inclination indicating the current arm angle. The target value supply unit 93*a* supplies a lower target value as the angle of inclination increases. Note that the target value may be determined by any method. The target tightening value may be calculated by substituting the angle of inclination into a given operational expression. The target value may be reduced gradually based on the determination whether the angle of inclination exceeds a threshold. A specified target value corresponding to a specified angle of inclination may be obtained by reference to a lookup table. Steps S400 and S402 to S408 are the same as Steps S300 and S302 to S308 shown in FIG. 16 and not redundantly described.

As shown in FIG. 20, the operation to lift the person being assisted 150 starts at time t50. Accordingly, the arm angle increases. Further, with the increase in the arm angle, the target tightening force (target value) decreases. At time t51, the lifting of the person being assisted 150 completes.

A specific way of detecting the arm angle is arbitrary. For example, the displacement of the link mechanism 23 may be measured using a rotary encoder or the like. The arm angle may be detected by measuring the position of the slider 21 on the rail 17. A parameter different from the arm angle may be used as described above. When an actuator that drives the arm unit 20 is a linear actuator, the displacement of the linear actuator may be detected, and the current posture of the transfer assistance device 100 may be detected based on the detected value.

Fourth Embodiment

Figure 21:
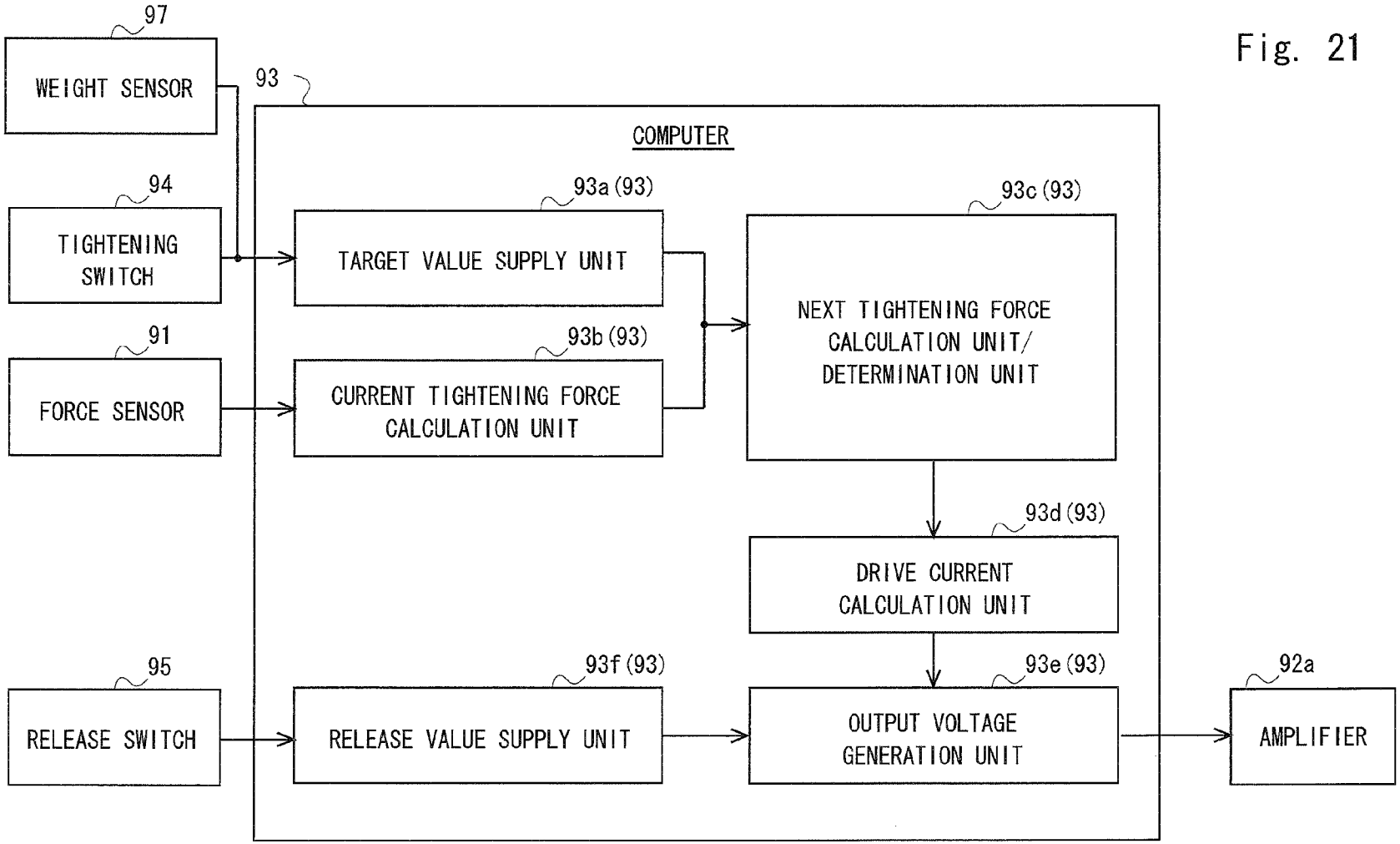
FIG. 21 is a schematic block diagram showing a configuration example of a computer according to a fourth embodiment.
Figure 22:
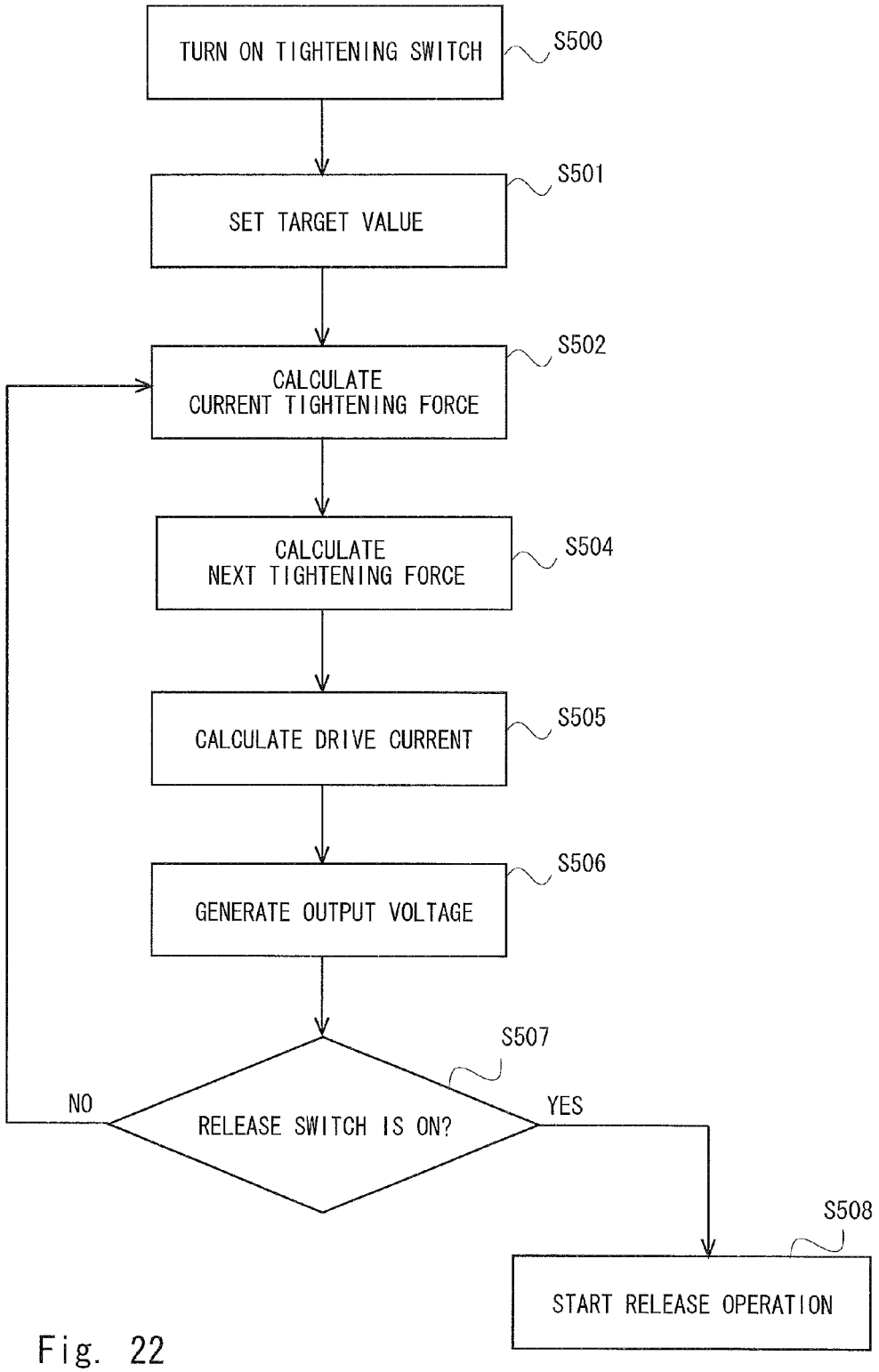
FIG. 22 is a schematic flowchart showing a tightening procedure according to the fourth embodiment.
Figure 23:
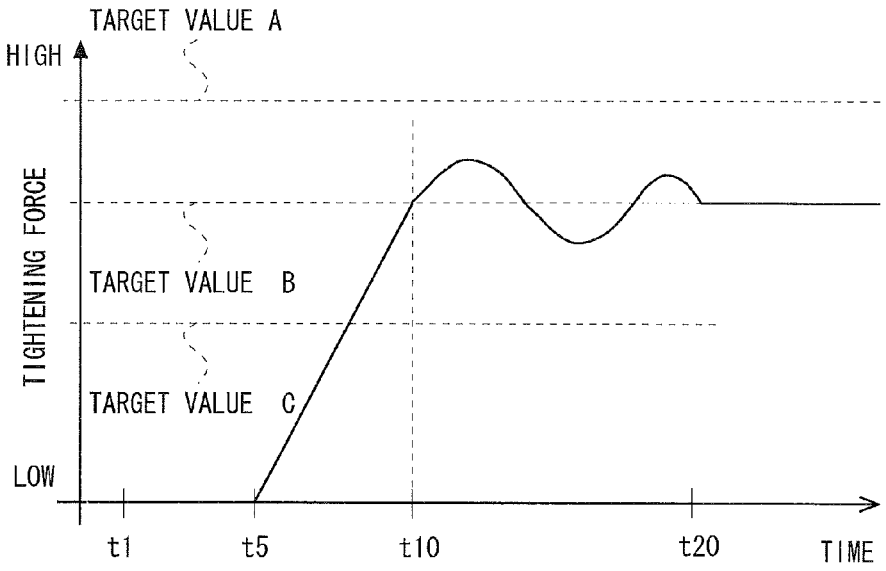
FIG. 23 is a timing chart showing the relationship between a target value and tightening force according to the fourth embodiment.

A fourth embodiment is described hereinafter with reference to FIGS. 21 to 23. FIG. 21 is a schematic block diagram showing a configuration example of a computer. FIG. 22 is a schematic flowchart showing a tightening procedure. FIG. 23 is a timing chart showing the relationship between a target value and tightening force.

In this embodiment, differently from the second embodiment, the target tightening force varies depending on the weight of the person being assisted 150. The tightening force that is required to lift the person being assisted 150 with a heavy weight is larger than that of the person being assisted 150 with a light weight. The tightening with the tightening force stronger than necessary to lift a person being assisted merely increases the discomfort of the person being assisted. Thus, in this embodiment, the target tightening force according to the weight of a person being assisted is set. It is thereby possible to support each of persons being assisted 150 with different weights.

As shown in FIG. 21, the output of a weight sensor 97 is input to the computer 93. The output of the weight sensor 97 is connected to the target value supply unit 93*a*. The target value supply unit 93*a*outputs a target value according to the weight of the person being assisted 150. The target value supply unit 93*a* supplies a higher target value as the weight of the person being assisted 150 increases. Note that the way of inputting a weight value is arbitrary, and the weight of a person being assisted may be input by DIP (Dual In-line Package) switch, voice input, touch panel or the like.

As shown in FIG. 22, after the tightening switch is turned on, a target value is set (S501). Specifically, the target value supply unit 93*a* supplies the target value in accordance with the weight of the current person being assisted 150. The target value supply unit 93*a* supplies a higher target value as the weight of the person being assisted 150 increases. Note that the target value may be determined by any method. The target value may be calculated by substituting the detected weight into a given operational expression. The target value may be determined at several levels based on the determination whether the detected weight exceeds a threshold. A method on the basis of a lookup table may be employed. Steps S500 and S502 to S508 are the same as Steps S300 and S302 to S308 shown in FIG. 16 and not redundantly described.

As shown in FIG. 23, the tightening force increases after time t5. At time t10, the current tightening force becomes equal to the target value B supplied this time, and feedback control is performed to maintain the tightening force. For example, the target value A corresponds to persons being assisted with the weight of 90 kg or more. The target value B corresponds to persons being assisted with the weight of 60 kg to less than 90 kg. The target value C corresponds to persons being assisted with the weight of 30 kg to less than 60 kg.

Fifth Embodiment

Figure 24:
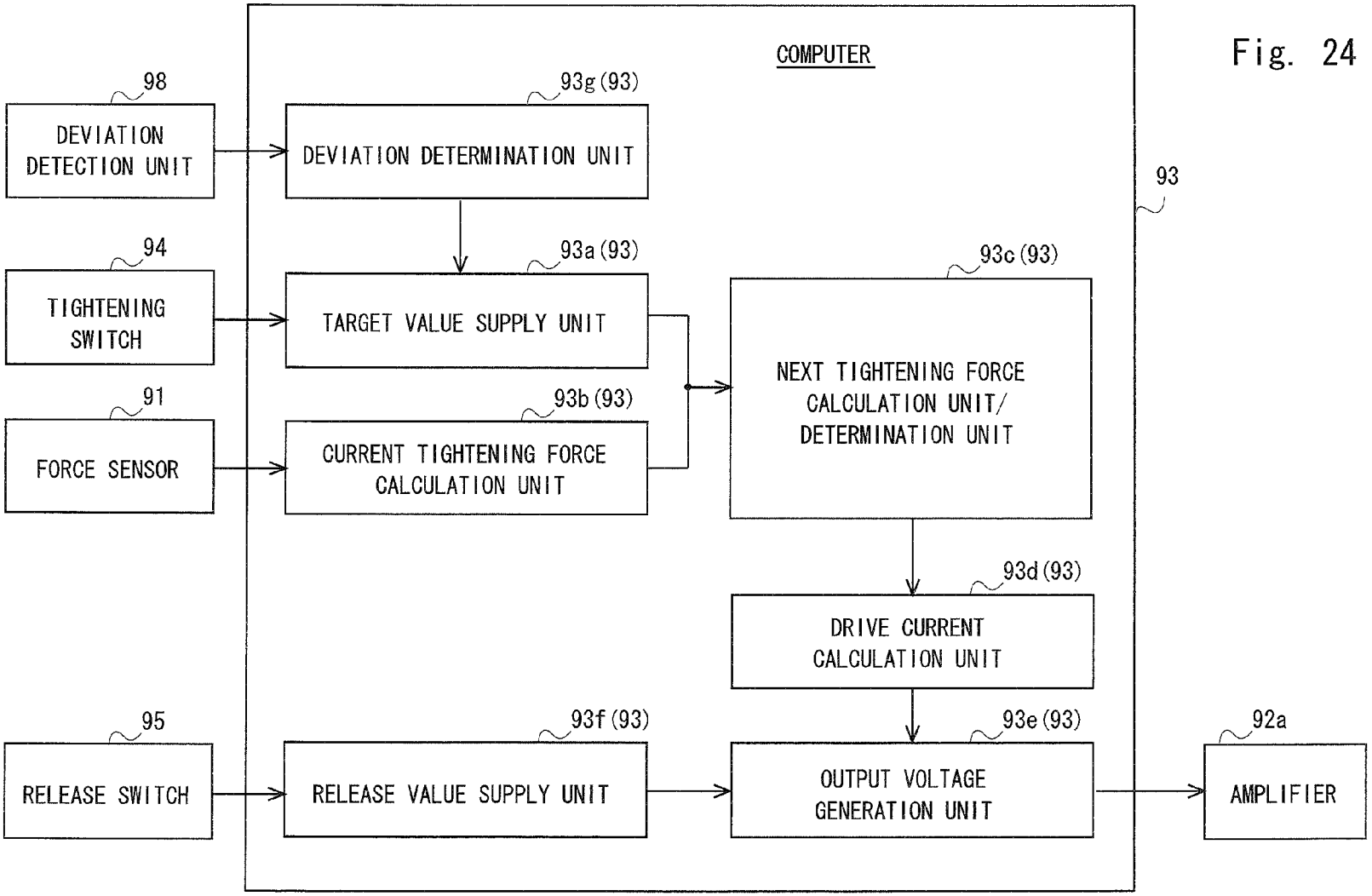
FIG. 24 is a schematic block diagram showing a configuration example of a computer according to a fifth embodiment.
Figure 25:
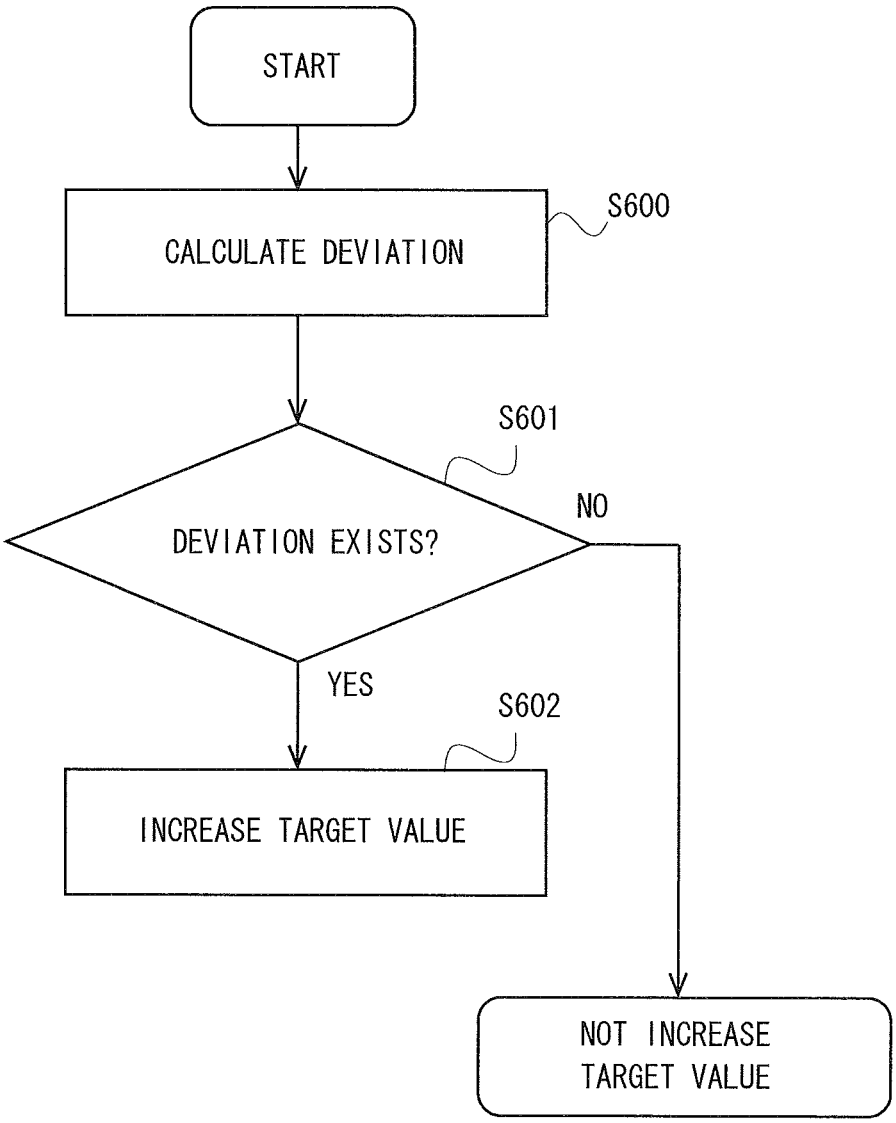
FIG. 25 is a schematic flowchart showing a procedure to change a target value according to the fifth embodiment.

A fifth embodiment is described hereinafter with reference to FIGS. 24 to 25. FIG. 24 is a schematic block diagram showing a configuration example of a computer. FIG. 25 is a schematic flowchart showing a procedure to change a target value.

In this embodiment, differently from the second embodiment, the deviation of the person being assisted 150 on the front supporting part 40 is detected, and the target value is changed in accordance with the deviation. More specifically, when the person being assisted 150 is deviated in position on the front supporting part 40 in the process of lifting the person being assisted 150, the target tightening value increases. It is thereby possible to tighten and support the person being assisted 150 in such a manner to effectively prevent the person being assisted 150 from coming off the front supporting part 40 in the process of lifting the person being assisted 150.

As shown in FIG. 24, the output of a deviation detection unit 98 is connected to the computer 93. The output of the deviation detection unit 98 is connected to a deviation determination unit 93*g*. The output of the deviation determination unit 93*g* is connected to the target value supply unit 93*a*.

A specific configuration of the deviation detection unit 98 is arbitrary. For example, the deviation detection unit 98 is configured using a displacement detection device incorporated into a mouse of the computer. The deviation detection unit 98 detects the displacement of the torso of the person being assisted 150 and outputs a value in accordance with the amount of displacement. The deviation determination unit 93*g* determines that there is a deviation when the amount of deviation is a threshold or more. When there is a deviation, the target value supply unit 93*a* supplies a higher target value. The deviation detection unit 98 may be configured using an image sensor, a contact displacement sensor or the like. Note that the detection of a deviation based on the image sensor is made by evaluating a difference in images acquired sequentially. The detection of a deviation based on the contact displacement sensor is made by detecting physical contact of a person being assisted with a contactor.

As shown in FIG. 25, the amount of deviation is calculated first (S600). Specifically, the deviation detection unit 98 detects a position deviation displacement of the person being assisted 150 placed on the front supporting part 40. Next, it is determined whether there is a deviation (S601). Specifically, the deviation determination unit 93*g*determines whether the amount of deviation is a threshold or more.

Note that the threshold is set to suppress the target tightening force from increasing due to a detection error. When there is a deviation, the target value is increased (S602). Specifically, the target value supply unit 93*a* supplies a higher target value according to the determination that there is a deviation. For example, the target value supply unit 93*a*supplies a target value increased by 20% than usual according to the determination that there is a deviation. When there is no deviation, an increase of the target value is not made.

Sixth Embodiment

Figure 26:
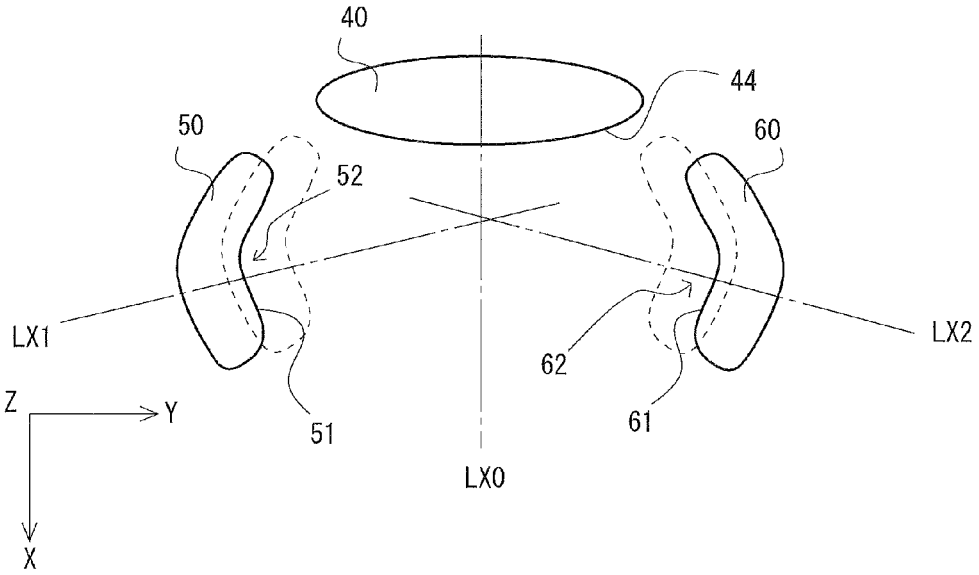
FIG. 26 is a schematic view of a side supporting part according to a sixth embodiment when viewed from the z-axis.
Figure 27:
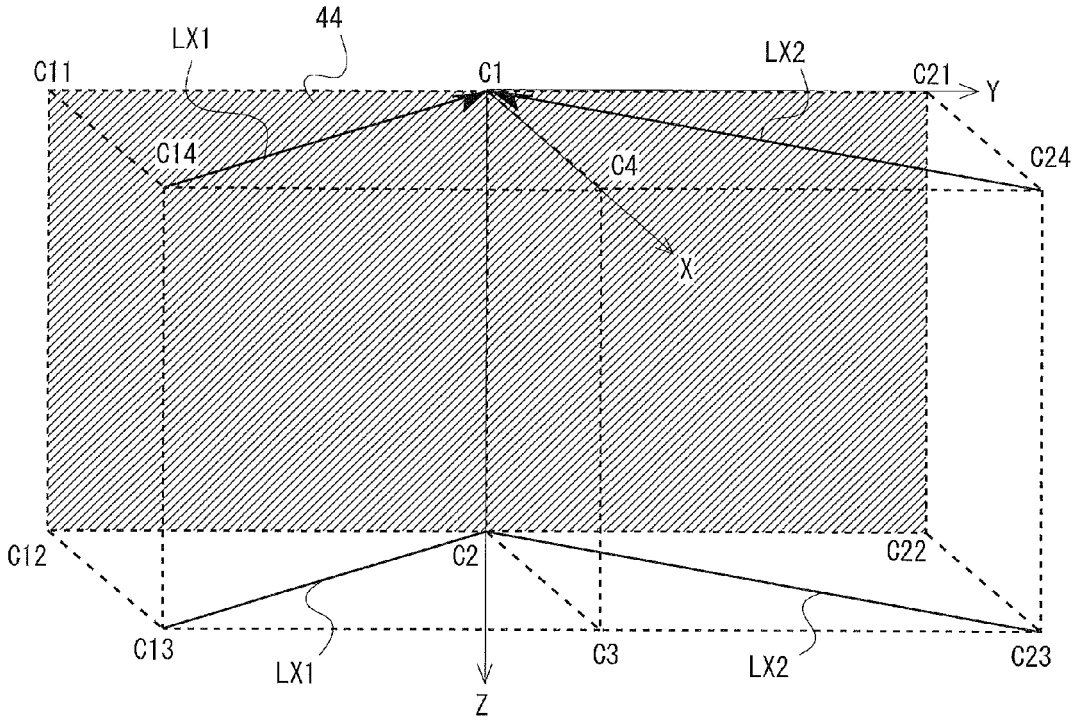
FIG. 27 is an explanatory view showing the moving direction of the side supporting part according to the sixth embodiment.
Figure 28:
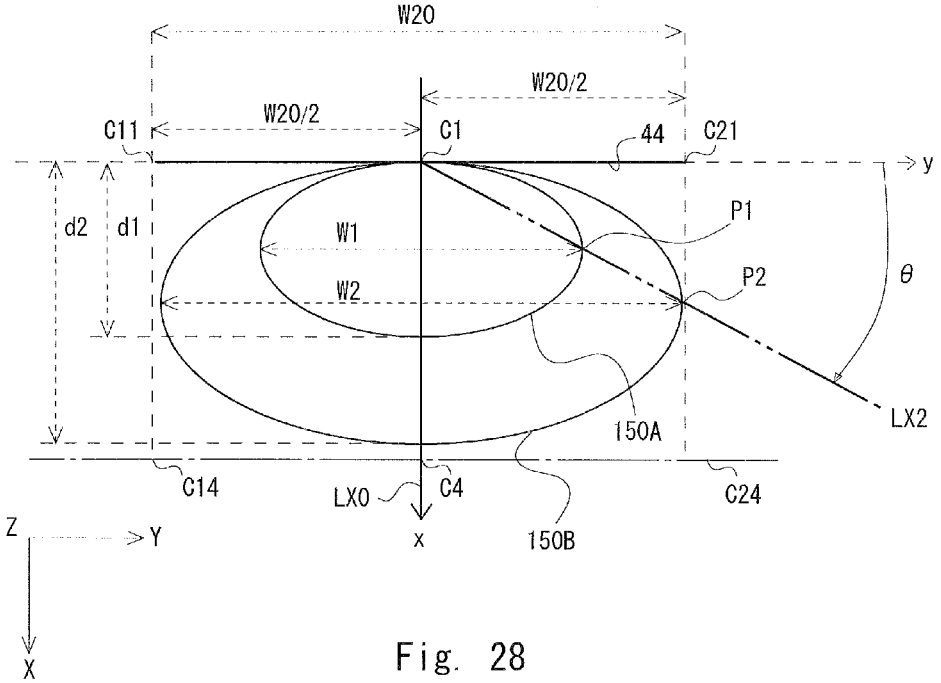
FIG. 28 is an explanatory view showing a method of setting the moving direction of the side supporting part according to the sixth embodiment.
Figure 29:
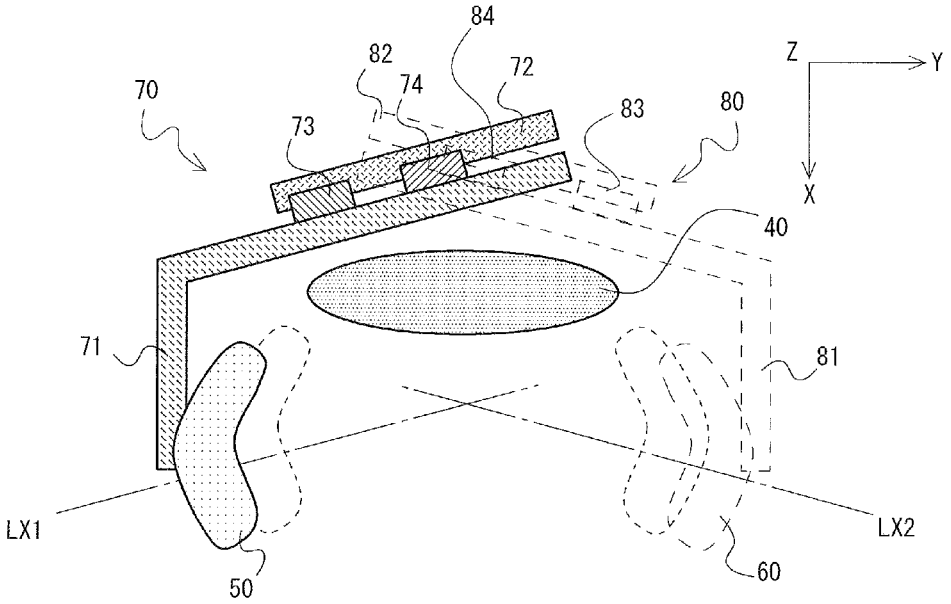
FIG. 29 is an explanatory view illustrating the mounting structure of the side supporting part according to the sixth embodiment.
Figure 30:
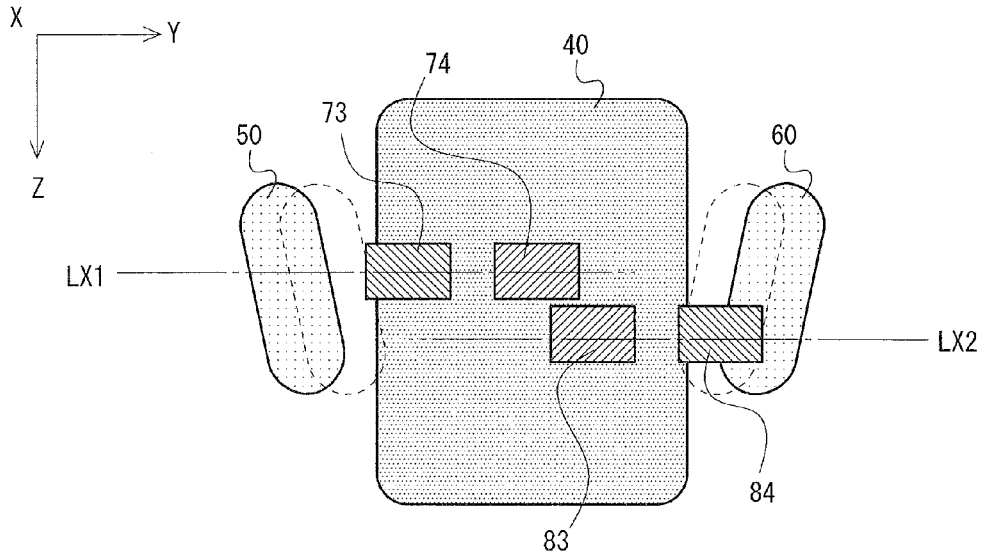
FIG. 30 is an explanatory view illustrating the mounting structure of the side supporting part according to the sixth embodiment.

A sixth embodiment is described hereinafter with reference to FIGS. 26 to 30. FIG. 26 is a schematic view of the side supporting parts 50 and 60 when viewed from the z-axis. FIG. 27 is an explanatory view showing the moving direction of the side supporting parts 50 and 60. FIG. 28 is an explanatory view showing a method of setting the moving direction of the side supporting parts 50 and 60. FIGS. 29 and 30 are explanatory views illustrating the mounting structure of the side supporting parts 50 and 60.

In this embodiment, differently from the above embodiments, the side supporting part 50 is displaced along the axis line LX1 shown in FIG. 26, and the side supporting part 60 is displaced along the axis line LX2 shown in FIG. 26. In this case also, the same effects as those of the above embodiments can be obtained.

The axis lines LX1 and LX2 are predetermined based on body shape values measured from the persons being assisted 150 with different body shapes. The moving paths of the side supporting parts 50 and 60 respectively indicated by the axis lines LX1 and LX2 correspond to different body shapes between the persons being assisted 150. By setting the moving paths of the side supporting parts 50 and 60, even when there is a difference in body shape between the persons being assisted 150 to be placed on the front supporting part 40, it is possible to hold and support the persons being assisted 150 by the side supporting parts 50 and 60 in such a manner to suppress the discomfort felt by the person being assisted 150 due to the difference in body shape. Further, according to this embodiment, it is possible to enlarge the range of persons being assisted for which one supporting element can be used. It is thereby possible to avoid the need to prepare a plurality of sizes of supporting elements.

As shown in FIG. 26, the side supporting part 50 is configured to be movable along the axis line LX1. The side supporting part 60 is configured to be movable along the axis line LX2. As is obvious from FIG. 26, the axis line LX1 has a specified inclination with respect to the z-y plane. Likewise, the axis line LX2 has a specified inclination with respect to the z-y plane. The axis line LX1 and the axis line LX2 are line-symmetrical. In this case, the line LX0 located on the center of the front supporting part 40 in the y-axis direction is a line of symmetry.

As shown in FIG. 27, a virtual three-dimensional space is set with the supporting surface 44 of the front supporting part 40 as a reference plane (note that the reference plane coincides with the side surface shown in FIG. 27). The three-dimensional space is made up of the lattice points C1 to C4, the lattice points C11 to C14, and the lattice points C21 to C24. The lattice points C1 and C2 are located at the center of the front supporting part 40 in the y-axis direction. The plane including the lattice points C1 to C4, the lane including the lattice points C11 to C14, and the lane including the lattice points C21 to C24 are x-z planes.

As shown in FIG. 27, the axis line LX1 is located on the lattice points C1 and C14 and connects the lattice point C14 and the lattice point C1. The axis line LX1 is located on the lattice points C2 and C13 and connects the lattice point C13 and the lattice point C2. The axis line LX2 is located on the lattice points C24 and C1 and connects the lattice point C24 and the lattice point C1. The axis line LX2 is located on the lattice points C2 and C23 and connects the lattice point C23 and the lattice point C2. The plane including the lattice points C1, C2, C13 and C14 are plane-symmetrical to the plane including the lattice points C1, C2, C23 and C24. At this time, the plane including the lattice points C1, C2, C3 and C4 serves as a plane of symmetry. Note that, although the axis line LX1 and the axis line LX2 are line-symmetrical to each other, not both of the axis lines LX1 and LX2 need to pass through the lattice point C1 shown in FIG. 27 (the same applies to the lattice point C2). Thus, in FIG. 27, the axis line LX1 may be shifted to the left in parallel along the y-axis, and the axis line LX2 may be shifted to the right in parallel along the y-axis when viewed from the front. In this case also, the effects of this embodiment are not hampered.

The side supporting part 50 moves toward the front supporting part 40 along the axis line LX1. In the process that the side supporting part 50 moves closer to the front supporting part 40, the interval between the side supporting part 50 and the front supporting part 40 in the x-axis direction is narrowed. It is thereby possible to hold the person being assisted 150 by the side supporting part 50 in a manner suitable for each person being assisted 150 leaning on the front supporting part 40. The relationship between the side supporting part 60 and the front supporting part 40 is the same.

A method of setting the axis line LX2 is described hereinafter with reference to FIG. 28. Note that a method of setting the axis line LX1 is apparent from the explanation of the method of setting the axis line LX2, and the explanation of the method of setting the axis line LX1 is omitted.

The angle θ of the axis line LX2 with respect to the supporting surface 44 of the front supporting part 40 is calculated by substituting the body shape values of a person being assisted 150A and a person being assisted 150B into a specified function. The body shape of the person being assisted 150A and the body shape of the person being assisted 150B are different from each other. Specifically, the body width of the person being assisted 150A is W1, and the body thickness is d1. The body width of the person being assisted 150B is W2, and the body thickness is d2. The conditions of W1<W2 and d1<d2 are satisfied. It is assumed that the centers of the persons being assisted 150A and 150B in the y-axis direction are respectively on the center of the front supporting part 40 in the y-axis direction (this is the same in the following embodiments).

The angle θ of the axis line LX2 with respect to the supporting surface 44 of the front supporting part 40 can be calculated from the following expression (1):

$$\theta = \mathrm{Arctan}\left(\frac{d2 - d1}{w2 - w1}\right) \tag{1}$$

By calculating the angle θ in this manner, the path of the axis line LX2, which is the side supporting part 50, is set. Note that a specific method of calculating the axis line is arbitrary and not limited to above.

The above expression (1) is further described. As shown in FIG. 28, the axis line LX2 is located on the side center point P1 of the torso of the person being assisted 150A and the side center point P2 of the torso of the person being assisted 150B. The side center point P1 is located at the position of (x,y)=(d1/2,w1/2). The side center point P2 is located at the position of (x,y)=(d2/2,w2/2). When the centers of the torso of the respective persons being assisted 150 in the y-axis direction are at the same position, the axis line LX2 (angle θ) can be obtained by connecting the side center points of the respective persons being assisted 150. Note that the center of the person being assisted 150 in the y-axis direction is located on the line of symmetry LX0 described above. The line of symmetry LX0 coincides with the parting line that divides the width W20 of the front supporting part 40 in the y-axis direction into two sections.

The body shape values such as W1, W2, d1 and d2 are acquired by actually measuring the body shape of the person being assisted 150. As the width and thickness of the body, the width and thickness of the chest may be used. For example, under the conditions of (the person being assisted 150A: the chest width W1=260 mm and the chest thickness=182 mm; the person being assisted 150B: the chest width W2=347 mm and the chest thickness =258 mm), the angle θ=41° is calculated.

The range of the value of the angle θ may have a certain width. The range of the value of the angle θ is affected depending on which part of the person being assisted 150 is supported by the side supporting part 50. In the case of pressing and supporting the torso of the person being assisted 150 by the side supporting part 50 as in this example, the angle θ is preferably set to the range of 0° to 60°. More preferably, the angle θ is set to the range of 30° to 60°. This makes the support of the person being assisted 150 more suitable. Note that the angle θ is also called the moving angle of the side supporting part.

In this embodiment, the moving path of the side supporting part 50 is determined based on the body shape values measured from the persons being assisted 150 with different body shapes. As a result, the moving path of the side supporting part 50 corresponds to a difference in body shape between the persons being assisted 150. By setting the moving path of the side supporting part 50 in this manner, even when there is a difference in body shape between the persons being assisted 150 leaning on the front supporting part 40, it is possible to hold and support the persons being assisted 150 by the side supporting part 50 in such a manner to suppress the discomfort felt by the person being assisted 150 due to the difference in body shape.

In this embodiment, the propulsion direction of the side supporting parts 50 and 60 when pressing the side supporting parts 50 and 60 against the person being assisted 150 substantially coincides with the direction in which the person being assisted 150 being held by the side supporting parts 50 and 60 is pushed by the side supporting parts 50 and 60. Specifically, when an assisting person presses the side supporting parts 50 and 60 against the person being assisted 150, the direction in which the assisting person pushes the side supporting parts 50 and 60 coincides with the direction in which the person being assisted 150 should be held by the side supporting parts 50 and 60. Thus, the direction of pushing the side supporting parts 50 and 60 by an assisting person and the direction of pushing the person being assisted 150 by the side supporting parts 50 and 60 are substantially coaxial. It is thereby possible to adjust the position of the side supporting parts 50 and 60 in a natural manner and suppress excessive force from being applied to the person being assisted 150. In the case of returning the posture of a set of the side supporting parts 50 and 60 from closed to open state also, the application of excessive force to the person being assisted 150 is prevented.

In this embodiment, the axis line LX2 coincides with the moving path of the recesses of the side supporting parts 50 and 60. The recesses of the side supporting parts 50 and 60 move along the axis line LX2, and the recesses of the side supporting parts 50 and 60 are placed near the center on the side of the torso of the person being assisted 150 regardless of a difference in body shape of the person being assisted 150. It is thereby possible to bring the internal side surfaces of the side supporting parts 50 and 60 and the outer periphery of the torso of the person being assisted 150 into contact with each other over a wider range, thus effectively avoiding that the side supporting parts 50 and 60 come into contact with the person being assisted 150 locally.

The mounting structure of the side supporting parts 50 and 60 onto the front supporting part 40 is additionally described with reference to FIGS. 29 and 30. As is obvious from FIGS. 29 and 30, the structure of the joint parts 70 and 80 is varied as appropriate in accordance with a change in the moving paths of the side supporting parts 50 and 60.

In this embodiment, the arm 71 is configured to be movable along the axis line LX1, and the side supporting part 50 attached at the front end of the arm 71 is movable along the axis line LX1. In the process that the side supporting part 50 moves closer to the front supporting part 40, the interval between the side supporting part 50 and the front supporting part 40 in the x-axis direction is narrowed. It is thereby possible to suitably press the side supporting part 50 against the torso of the person being assisted 150 even when there is a difference in body shape between persons being assisted 150.

As described with reference to FIG. 28, the body width and body thickness of the person being assisted 150 differ significantly depending on the body shape (body type) of the person being assisted 150. In this case, the side supporting parts 50 and 60 sometimes cannot be suitably pressed against each person being assisted 150 only by moving the side supporting parts 50 and 60 in parallel in the direction parallel to the supporting surface 44 of the front supporting part 40.

In this embodiment, as described with reference to FIG. 28, the correlation between the body shapes of the respective persons being assisted 150 is calculated as the inclination θ of the axis line with respect to the supporting surface 44 of the front supporting part 40 based on the body shape values (body width and body thickness) of the respective persons being assisted 150 with different body shapes. Specifically, the side supporting parts 50 and 60 are made movable along the axis line intersecting the supporting surface 44 of the front supporting part 40 at the inclination θ. It is thereby possible to press the side supporting parts 50 and 60 against a specified part of the torso of each person being assisted 150 in the same manner even when there is a difference in body shape between the persons being assisted 150.

In the case where the supporting surfaces of the side supporting parts 50 and 60 have recesses, it is preferred to ensure the suitable contact state between the side surface of the torso of the person being assisted 150 and the supporting surfaces. In this embodiment, the moving paths of the recesses on the supporting surfaces of the side supporting parts 50 and 60 are calculated based on the side center points of the respective persons being assisted 150 with different body shapes as described above. The recesses on the supporting surfaces of the side supporting parts 50 and 60 are thereby placed at the positions corresponding to the centers of the sides of the person being assisted 150, thereby allowing the sides of the person being assisted 150 to be suitably held by the side supporting parts 50 and 60 regardless of a difference in body shape of the persons being assisted 150. Note that the side supporting parts 50 and 60 may be configured to open and close in a cooperative manner. The side supporting parts 50 and 60 may be configured to open and close independently of each other.

Seventh Embodiment

Figure 31:
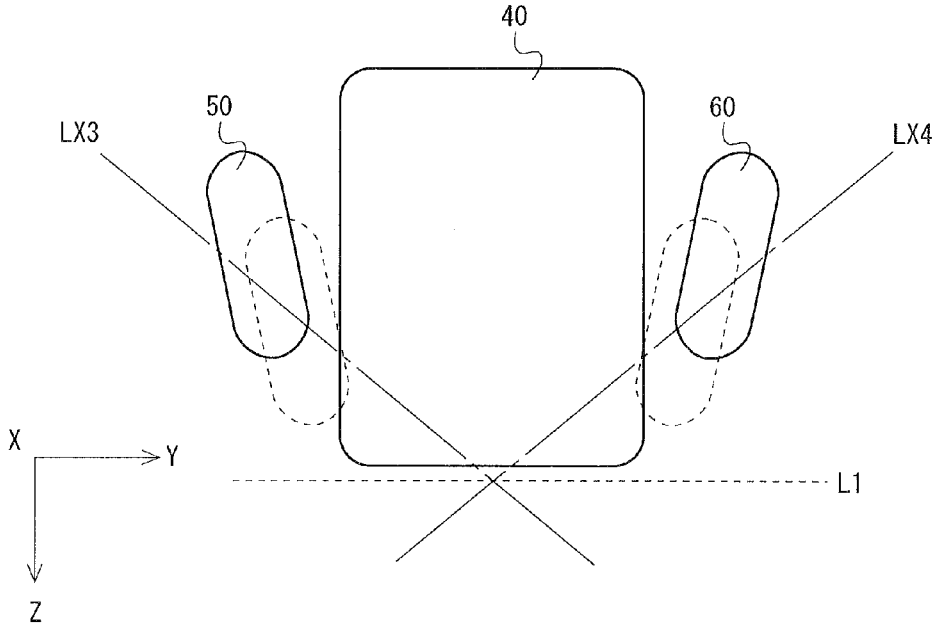
FIG. 31 is an explanatory view showing the moving direction of a side supporting part according to a seventh embodiment.
Figure 32:
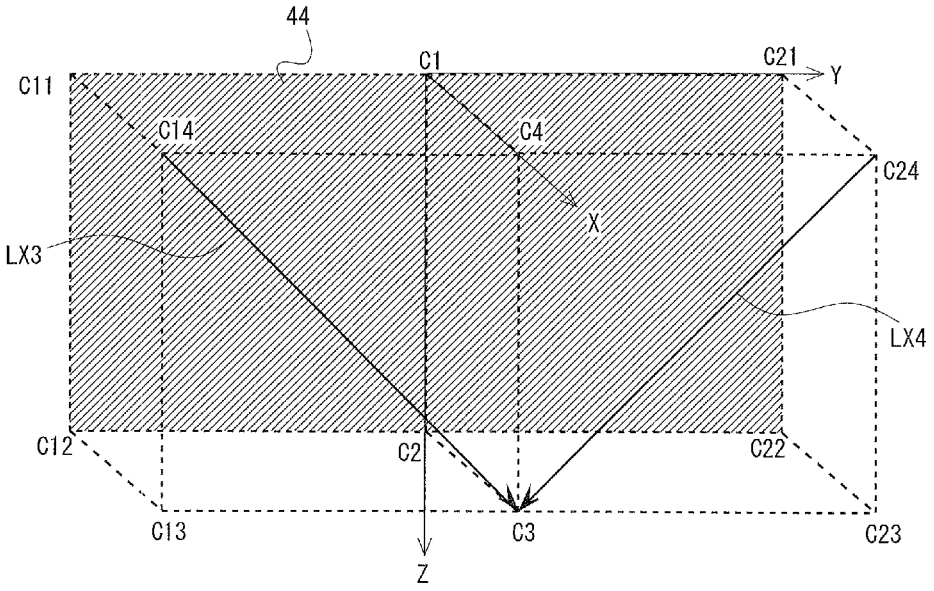
FIG. 32 is an explanatory view showing the moving direction of the side supporting part according to the seventh embodiment.
Figure 33:
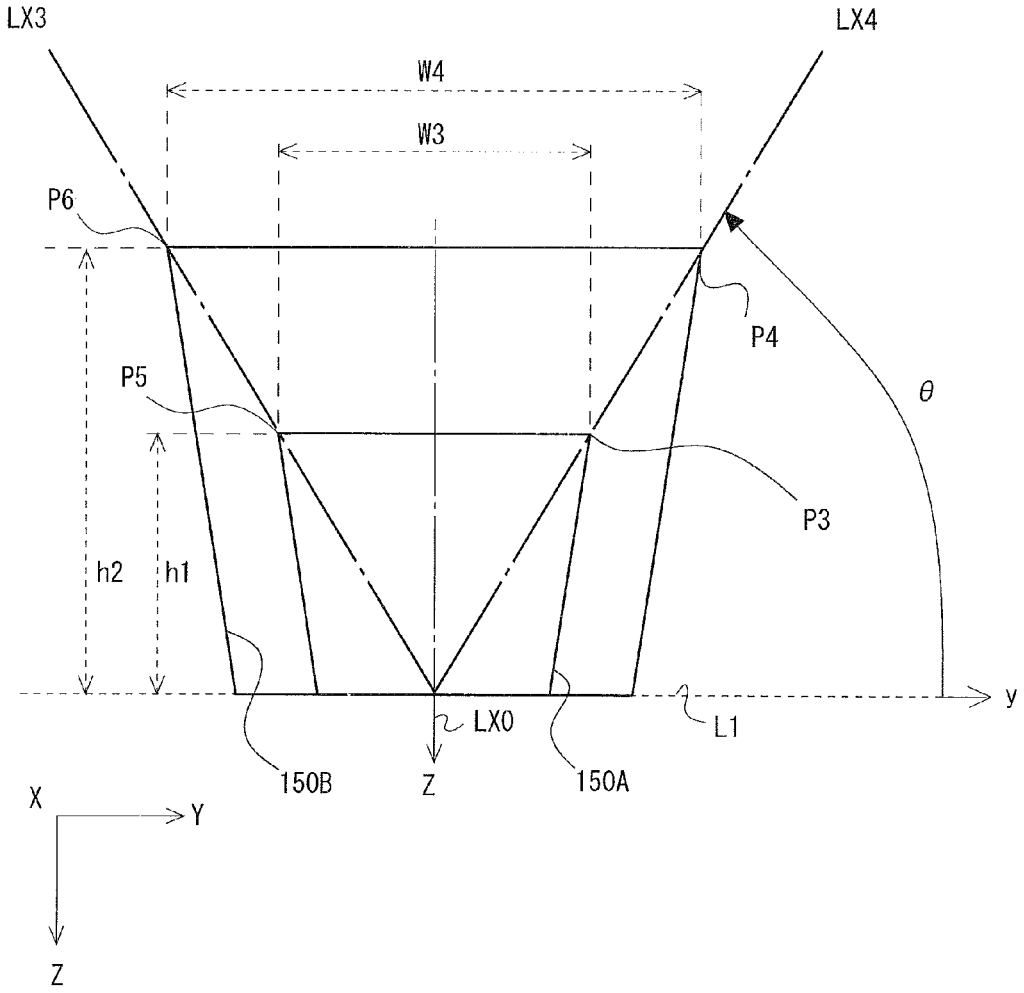
FIG. 33 is an explanatory view showing a method of setting the moving direction of the side supporting part according to the seventh embodiment.
Figure 34:
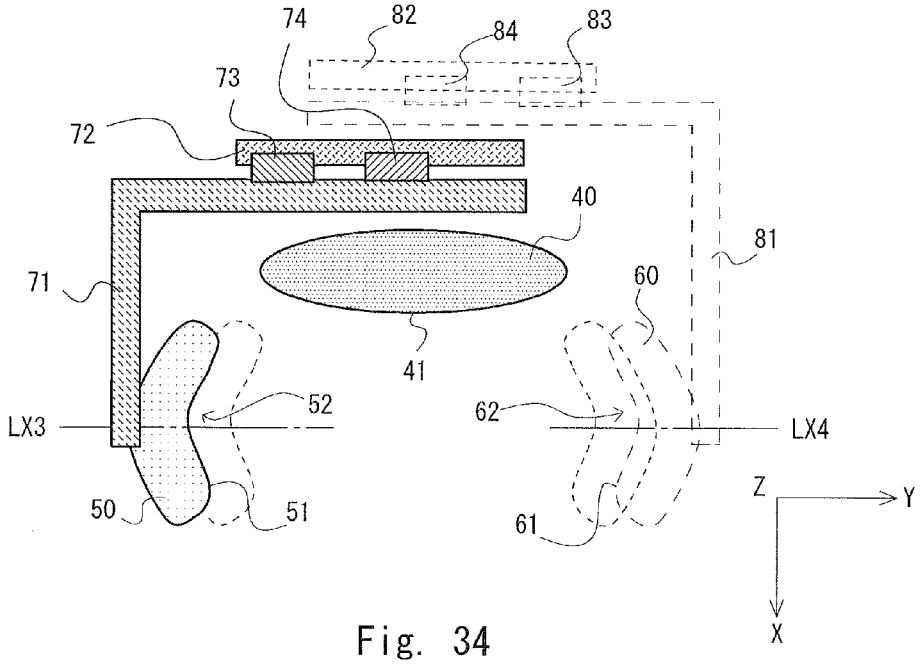
FIG. 34 is an explanatory view illustrating the mounting structure of the side supporting part according to the seventh embodiment.
Figure 35:
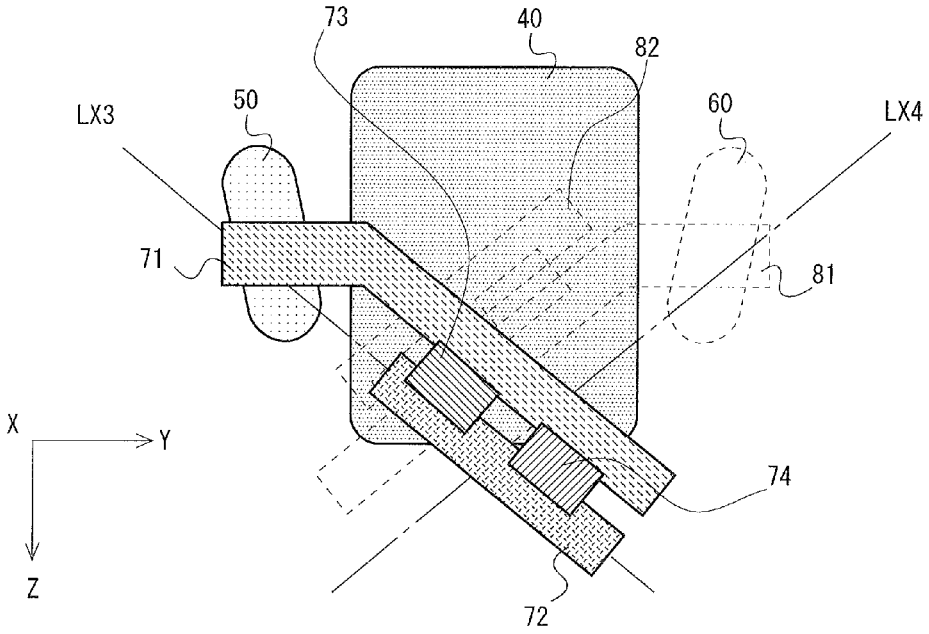
FIG. 35 is an explanatory view illustrating the mounting structure of the side supporting part according to the seventh embodiment.

A seventh embodiment is described hereinafter with reference to FIGS. 31 to 35. FIGS. 31 and 32 are explanatory views showing the moving direction of the side supporting parts 50 and 60. FIG. 33 is an explanatory view showing a method of setting the moving direction of the side supporting parts 50 and 60. FIGS. 34 and 35 are explanatory views illustrating the mounting structure of the side supporting parts 50 and 60.

In this embodiment, differently from the sixth embodiment, the side supporting part 50 move along the axis line LX3 and the side supporting part 60 moves along the axis line LX4 when the front supporting part 40 is viewed from the front as schematically shown in FIG. 31. It is thus possible to press the side supporting parts 50 and 60 from the sides against the narrow part of the chest of the person being assisted 150 and thereby reduce the feeling of oppression given to the person being assisted 150. Note that, like the axis lines LX1 and LX2 in the sixth embodiment, the axis lines LX3 and LX4 are determined based on a difference in body shape of the persons being assisted 150. This becomes apparent from the following description.

As shown in FIG. 31, when the side supporting part 50 moves inward (toward the front supporting part 40) along the axis line LX3, it moves downward (toward the feet of the person being assisted 150) in the z-axis direction (the lengthwise direction of the supporting surface of the front supporting part 40). When the side supporting part 60 moves inward along the axis line LX4, it moves downward in the z-axis direction. Note that the downside in the z-axis direction corresponds to the feet side of the person being assisted 150.

As schematically shown in FIG. 32, the axis line LX3 lies in parallel to the supporting surface 44 of the front supporting part 40 and is located on the lattice points C3 and C14. The axis line LX4 lies in parallel to the supporting surface 44 of the front supporting part 40 and is located on the lattice points C3 and C24. Note that, although the axis line LX3 and the axis line LX4 are line-symmetrical to each other, not both of the axis lines LX3 and LX4 need to pass through the lattice point C3 shown in FIG. 32. Thus, in FIG. 32, the axis line LX3 may be shifted to the left in parallel along the y-axis, and the axis line LX4 may be shifted to the right in parallel along the y-axis when viewed from the front (it is assumed that the lattice point C1 is the upper side, the lattice point C2 is the lower side, the lattice point C21 is the right side, and the lattice point C11 is the left side). In this case also, the effects of this embodiment are not hampered.

A method of setting the axis line LX4 is described hereinafter with reference to FIG. 33. Note that a method of setting the axis line LX3 is apparent from the explanation of the method of setting the axis line LX4, and the explanation of the method of setting the axis line LX3 is omitted.

When the width direction of the torso of the person being assisted 150 supported by the front supporting part 40 is the line L1 (see FIG. 31 also), the angle θ of the axis line LX4 with respect to the line L1 is calculated by substituting the body shape values of a person being assisted 150A and a person being assisted 150B into a specified function. The body shape of the person being assisted 150A and the body shape of the person being assisted 150B are different from each other. Specifically, the body width of the person being assisted 150A is W3, and the trunk length is h1. The body width of the person being assisted 150B is W4, and the trunk length is h2. The conditions of W3<W4 and h1<h2 are satisfied. The centers of the persons being assisted 150A and 150B in the y-axis direction are respectively on the center of the front supporting part 40 in the y-axis direction, respectively.

The angle θ of the axis line LX4 with respect to the line L1 can be calculated from the following expression (2):

$$\theta = \mathrm{Arctan}\left(\frac{2\times(h2-h1)}{w4-w3}\right) \tag{2}$$

By calculating the angle θ in this manner, the path of the side supporting part 60 as the axis line LX4 is set. Note that a specific method of calculating the axis line LX4 is arbitrary and not limited to above.

The above expression (2) is further described. As shown in FIG. 33, the axis line LX4 is located on the feature point P3 corresponding to the shoulder of the person being assisted 150A and the feature point P4 corresponding to the shoulder of the person being assisted 150B. The point P3 is located at the position of (z,y)=(−h1,W3/2). The point P4 is located at the position of (z,y)=(−h2,W4/2). When the centers of the torso of the respective persons being assisted 150 in the y-axis direction are at the same position, the axis line LX4 can be defined by connecting the feature points determined from the body width and trunk length of the respective persons being assisted 150. Note that the center of the person being assisted 150 in the y-axis direction is located on the line of symmetry LX0 described above.

Specific values of W3, W4, h1 and h2 are arbitrary. As the body width and trunk length, the chest width and the chest height may be used. For example, under the conditions of (the person being assisted 150A: the chest width W=260 mm and the chest height =183 mm; the person being assisted 150B: the chest width W=347 mm and the chest height =402 mm), the angle θ=79° is calculated.

The range of the value of the angle θ preferably has a certain width as in the above-described embodiment. In this example, the angle θ is preferably set to the range of 0° to 85°. More preferably, the angle θ is set to the range of 35° to 85°. More preferably, the angle θ is set to the range of 55° to 85°. This makes the support of the person being assisted 150 more suitable. Note that the angle θ is also called the moving angle of the side supporting part.

As shown in FIGS. 34 and 35, the structure of the joint parts 70 and 80 is adjusted as appropriate in accordance with a change in the moving paths of the side supporting parts 50 and 60.

In this embodiment, the moving paths of the side supporting parts 50 and 60 are determined based on the body shape values (body width and trunk length) measured from the persons being assisted 150 with different body shapes. As a result, the moving paths of the side supporting parts 50 and 60 correspond to a difference in body shape between the persons being assisted 150. Thus, even when there is a difference in body shape between the persons being assisted 150, it is possible to press the side supporting parts 50 and 60 against the narrow part of the chest of each person being assisted 150 in the same manner. Further, according to this embodiment, it is possible to enlarge the range of persons being assisted 150 for which one supporting element can be used. It is thereby possible to avoid the need to prepare a plurality of sizes of supporting elements.

In this embodiment, as described with reference to FIG. 33, the correlation between the body shapes of the respective persons being assisted 150 is calculated as the inclination θ of the axis line with respect to the line L1 based on the body shape values (body width and trunk length) of the respective persons being assisted 150 with different body shapes. Then, the side supporting parts 50 and 60 are made movable along the axis line intersecting the line L1 at the calculated inclination θ. It is thereby possible to press the side supporting parts 50 and 60 against a specified part of the torso of each person being assisted 150 in the same manner even when there is a difference in body shape between the persons being assisted 150.

Eighth Embodiment

An eighth embodiment is described hereinafter with reference to FIGS. 36 to 38. In this embodiment, by combining the above-described sixth and seventh embodiments, it is possible to press the side supporting parts 50 and 60 against each person being assisted 150 in a suitable manner regardless of an individual difference in their body width, body thickness and trunk length. It is thereby possible to obtain the effects described in the above embodiments in a synergistic manner. Note that the redundant description of the sixth and seventh embodiments is omitted.

Figure 36:
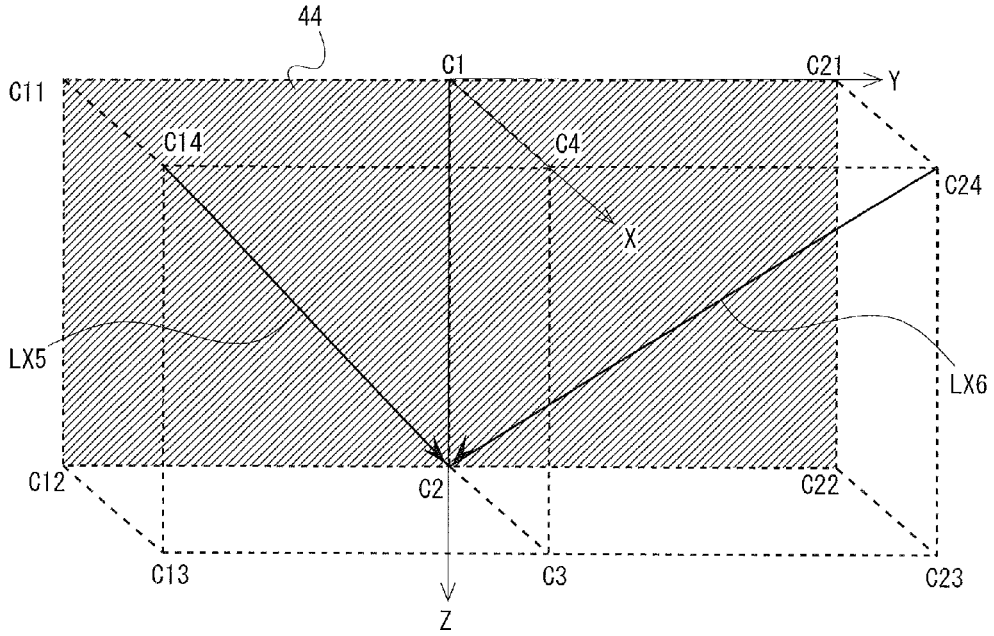
FIG. 36 is an explanatory view showing the moving direction of a side supporting part according to an eighth embodiment.

As schematically shown in FIG. 36, the axis line LX5 is located on the lattice points C2 and C14. The axis line LX6 is located on the lattice points C2 and C24. The side supporting part 50 moves along the axis line LX5. The side supporting part 60 moves along the axis line LX6. The axis line LX5 coincides with the synthetic vector of the axis line LX1 shown in FIG. 27 and the axis line LX3 shown in FIG. 32. The axis line LX6 coincides with the synthetic vector of the axis line LX2 shown in FIG. 27 and the axis line LX4 shown in FIG. 32. Thus, the axis line LX5 is set by separately calculating the axis lines LX1 and LX3 and then calculating the synthetic vector of the axis lines LX1 and LX3. The axis line LX6 is set by separately calculating the axis lines LX2 and LX4 and then calculating the synthetic vector of the axis lines LX2 and LX4. Note that, although the axis line LX5 and the axis line LX6 are line-symmetrical to each other, not both of the axis lines LX5 and LX6 need to pass through the lattice point C2 shown in FIG. 36. Thus, in FIG. 36, the axis line LX5 may be shifted to the left in parallel along the y-axis, and the axis line LX6 may be shifted to the right in parallel along the y-axis when viewed from the front (it is assumed that the lattice point C1 is the upper side, the lattice point C2 is the lower side, the lattice point C21 is the right side, and the lattice point C11 is the left side). In this case also, the effects of this embodiment are not hampered.

Figure 37:
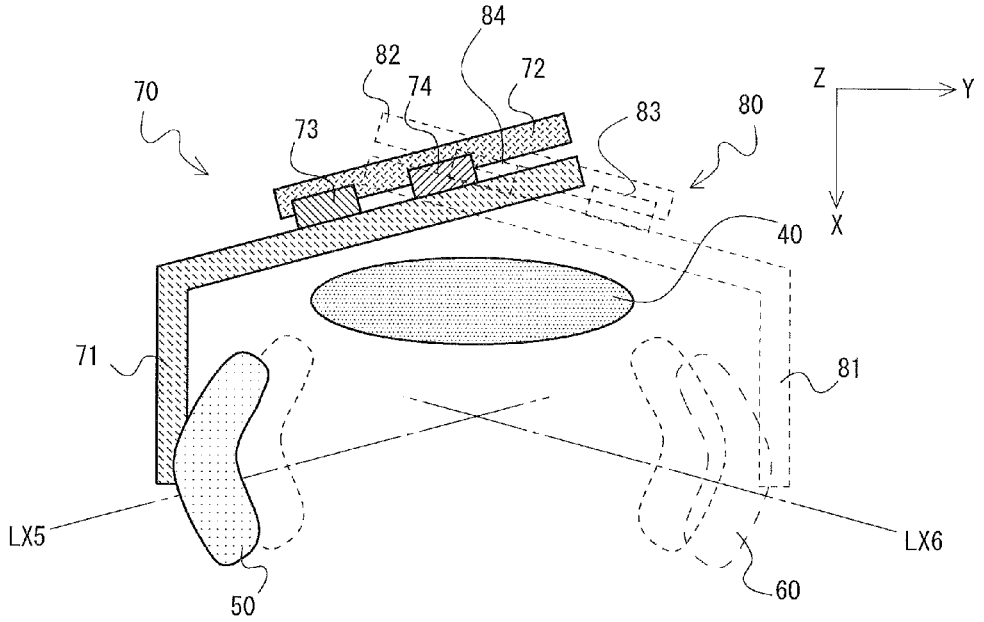
FIG. 37 is an explanatory view illustrating the mounting structure of the side supporting part according to the eighth embodiment.
Figure 38:
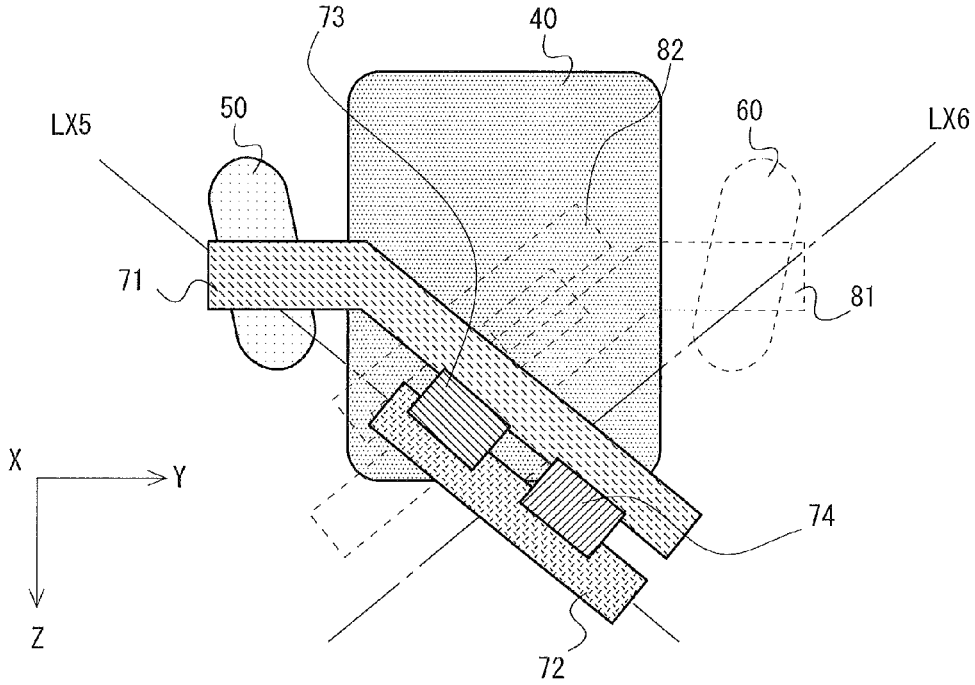
FIG. 38 is an explanatory view illustrating the mounting structure of the side supporting part according to the eighth embodiment.

As schematically shown in FIGS. 37 and 38, the structure of the joint parts 70 and 80 is varied as appropriate in accordance with a change in the moving paths of the side supporting parts 50 and 60.

In this embodiment, the moving paths of the side supporting part 50 are determined based on the body shape values (body width, body thickness and trunk length) measured from the persons being assisted 150 with different body shapes, and therefore the moving paths of the side supporting parts 50 and 60 correspond to a difference in body shape between the persons being assisted 150. It is thereby possible to obtain the effects described in the sixth and seventh embodiments in a synergistic manner. For example, even when there is a difference in body shape between the persons being assisted 150 leaning on the front supporting part 40, it is possible to hold and support the persons being assisted 150 by the side supporting parts 50 and 60 in such a manner to suppress the discomfort felt by the person being assisted 150 due to the difference in body shape. Further, even when there is a difference in body shape between the persons being assisted 150, it is possible to press the side supporting parts 50 and 60 against the narrow part of the chest of each person being assisted 150 in the same manner. Furthermore, it is possible to enlarge the range of persons being assisted 150 for which one supporting element can be used.

The present invention is not restricted to the above-described embodiments, and various changes and modifications may be made without departing from the scope of the invention. The embodiments can be combined as desirable by one of ordinary skill in the art, and multiplier effects thereof can be also claimed. For example, the features described in the sixth to eighth embodiments may be applied to any of the first to fifth embodiments.

INDUSTRIAL APPLICABILITY

The present invention is applicable to a transfer assistance device, for example.

REFERENCE SIGNS LIST

100 TRANSFER ASSISTANCE DEVICE
10 BOGIE UNIT
20 ARM UNIT
30 SUPPORTING UNIT
40 FRONT SUPPORTING PART
50 SIDE SUPPORTING PART
60 SIDE SUPPORTING PART
70 JOINT PART
80 JOINT PART
91 FORCE SENSOR
92 DRIVING UNIT
93 COMPUTER
94 SWITCH
95 RELEASE SWITCH
96 INCLINATION SENSOR
97 WEIGHT SENSOR
98 DEVIATION DETECTION UNIT

The invention claimed is:

1. A transfer assistance device comprising: a main supporting part that supports a torso of a person being assisted so that the position of the person can be changed between a sitting position and a standing position; a set of sub supporting parts engaged with the main supporting part through a joint part having a linearly extending portion in a manner being adjustable in position with respect to the main supporting part; a driving unit that drives each of the set of sub supporting parts in a straight line toward the person being assisted in a state of being supported by the main supporting part in a state where opposed postures of the sub supporting parts are roughly maintained in a manner that movement of the sub supporting part is guided by the portion of the joint part; a pressure detection unit that detects a pressure proportional to propulsion principally composed of a rectilinear component of the sub supporting part driven by the driving unit and counterforce generated by contact of the sub supporting part with the person being assisted; and a control unit that controls the driving unit based on a detected value of the pressure detected by the pressure detection unit so that tightening force on the person being assisted caused by the sub supporting part approaches prescribed tightening force, wherein the pressure detection unit is mounted on the joint part.

2. The transfer assistance device according to claim 1, wherein the main supporting part and the set of sub supporting parts are mounted on an arm unit, the arm unit is mounted on a body unit in such a manner to allow lifting of the person being assisted, and the prescribed tightening force varies depending on a displacement of the arm unit with respect to the body unit.

3. The transfer assistance device according to claim 1, wherein the prescribed tightening force varies depending on a weight of the person being assisted.

4. The transfer assistance device according to claim 1, where the main supporting part is set at least in a range capable of supporting at least an entire chest of the person being assisted, further comprising:

a deviation detection unit that detects a deviation of the torso of the person being assisted on the main supporting part, wherein the prescribed tightening force to be achieved by drive control of the sub supporting part varies in accordance with a detected value of the deviation detection unit.

5. The transfer assistance device according to claim 1, wherein the pressure detection unit receives the propulsion and the counterforce generated coaxially.

6. The transfer assistance device according to claim 1, wherein the set of sub supporting parts are displaced in accordance with power generated by a common power source.

7. The transfer assistance device according to claim 1, wherein the control unit controls the driving unit so as to prevent the tightening force on the person being assisted caused by the sub supporting part from being separated from the prescribed tightening force.

8. The transfer assistance device according to claim 1, wherein at least one of the set of sub supporting parts is configured to be movable along an axis line determined based on an individual difference in size of the torso of the person being assisted placed on the main supporting part.

9. The transfer assistance device according to claim 8, wherein a height position of the sub supporting part with respect to a supporting surface of the main supporting part or a position of the sub supporting part in a lengthwise direction of the supporting surface of the main supporting part varies in synchronization with movement of the sub supporting part along the axis line toward the torso of the person being assisted placed on the main supporting part.

10. An operation method for a transfer assistance device including a main supporting part that supports a torso of a person being assisted so that the position of the person can be changed between a sitting position and a standing position, a set of sub supporting parts engaged with the main supporting part through a joint part having a linearly extending portion in a manner being adjustable in position with respect to the main supporting part, and a driving unit that drives each of the set of sub supporting parts in a straight line toward the person being assisted in a state of being supported by the main supporting part in a state where opposed postures of the sub supporting parts are roughly maintained in a manner that movement of the sub supporting part is guided by the portion of the joint part, the method comprising: detecting a pressure proportional to propulsion principally composed of a rectilinear component of the sub supporting part driven by the driving unit and counterforce generated by contact of the sub supporting part with the person being assisted using a pressure detection unit mounted on the joint part; and controlling the driving unit based on a detected value of the pressure detected by the pressure detection unit so that tightening force on the person being assisted caused by the sub supporting part approaches prescribed tightening force.

* * * * *

UNITED STATES PATENT AND TRADEMARK OFFICE

CERTIFICATE OF CORRECTION

PATENT NO. : 9,038,212 B2
APPLICATION NO. : 13/996141
DATED : May 26, 2015
INVENTOR(S) : Y. Yamaguchi et al.

It is certified that error appears in the above-identified patent and that said Letters Patent is hereby corrected as shown below:

In the specification

At column 24, line 8, change “width W=260 mm” to -- width W3=260 mm --.

At column 24, line 10, change “width W=347 mm” to -- width W4=347 mm --.

Signed and Sealed this
Twenty-second Day of December, 2015

Michelle K. Lee

Michelle K. Lee
*Director of the United States Patent and Trademark Office*